US012280910B2

(12) United States Patent
Abayhan et al.

(10) Patent No.: US 12,280,910 B2
(45) Date of Patent: Apr. 22, 2025

(54) COLLAPSIBLE, HANGABLE PLASTIC BOTTLE

(71) Applicant: Abbott Laboratories, Abbott Park, IL (US)

(72) Inventors: Ayberk Abayhan, Dublin, OH (US); Emily Brudos, Worthington, OH (US); Jameel Ahmed, Hilliard, OH (US); James Perry, Gahanna, OH (US)

(73) Assignee: ABBOTT LABORATORIES, Abbott Park, IL (US)

( * ) Notice: Subject to any disclaimer, the term of this patent is extended or adjusted under 35 U.S.C. 154(b) by 50 days.

(21) Appl. No.: 18/141,787

(22) Filed: May 1, 2023

(65) Prior Publication Data

US 2024/0367846 A1 Nov. 7, 2024

(51) Int. Cl.
*B65D 1/02* (2006.01)
*B65D 25/22* (2006.01)

(52) U.S. Cl.
CPC ..... *B65D 1/0292* (2013.01); *B65D 25/22* (2013.01); *B65D 2501/0081* (2013.01)

(58) Field of Classification Search
CPC .. B65D 75/008; B65D 21/086; B65D 1/0292; B65D 25/22; B65D 2501/0081
See application file for complete search history.

(56) References Cited

U.S. PATENT DOCUMENTS 3,387,732 A 6/1968 Jellies
5,080,260 A 1/1992 Düring
D614,496 S 4/2010 Toh et al.
D625,606 S 10/2010 Hirst et al.
D632,181 S 2/2011 KuZma et al.
D642,065 S 7/2011 Araujo et al.
D649,060 S 11/2011 Wheaton et al.
D651,516 S 1/2012 Schaeffer
(Continued)

FOREIGN PATENT DOCUMENTS

EP 1689654 B1 8/2006
EP 1867572 B1 12/2007
(Continued)

OTHER PUBLICATIONS

EP Design Registration No. 000189220-0001, Mediq N.V., registered Jun. 14, 2004.

(Continued)

*Primary Examiner* — Shawn M Braden
(74) *Attorney, Agent, or Firm* — McAndrews, Held & Malloy, Ltd.

(57) ABSTRACT

The present disclosure is directed to bottles that are configured to undergo a controlled collapse in response to pressure being placed on the front and rear walls manually by a user, vacuum forces acting inside the bottle during a tube feeding process, or both. The bottles include a rigid hanging element that is molded into an access channel provided on the base of the bottle, such that the top and sides of the hanging element are fixedly connected with a surface of the container. Due to the presence of the hanging element, the bottle includes hinge lines focus the collapse in the central area of the bottle between the hanging element and the shoulder of the bottle. Accordingly, the present bottles provide both a rigid hanging element and walls that collapse in a controlled manner.

38 Claims, 23 Drawing Sheets

(56) References Cited

U.S. PATENT DOCUMENTS

| | | | | |
|---|---|---|---|---|
| 8,172,110 | B2 | 5/2012 | Beine et al. | |
| 8,178,140 | B2 | 5/2012 | Kuboi et al. | |
| 8,365,954 | B2 | 2/2013 | Ophardt et al. | |
| 8,631,963 | B2 | 1/2014 | Lane et al. | |
| 8,672,183 | B2 | 3/2014 | Ophardt et al. | |
| D709,771 | S | 7/2014 | Letamendi | |
| 8,910,673 | B2 | 12/2014 | Tsuda et al. | |
| 8,944,288 | B2 | 2/2015 | Ciavarella et al. | |
| D723,377 | S | 3/2015 | Janney | |
| 9,126,712 | B2 | 9/2015 | Lausted et al. | |
| D746,149 | S | 12/2015 | Ginzburg et al. | |
| 10,221,001 | B2 | 3/2019 | Zancan et al. | |
| D864,723 | S | 10/2019 | Banerjee et al. | |
| 10,507,611 | B2 | 12/2019 | Brandenburger et al. | |
| D883,788 | S | 5/2020 | Kuhn et al. | |
| D886,615 | S | 6/2020 | Van Skaik et al. | |
| D886,625 | S | 6/2020 | Van Skaik et al. | |
| D893,301 | S | 8/2020 | Van Skaik et al. | |
| D901,300 | S | 11/2020 | Van Skaik et al. | |
| D904,874 | S | 12/2020 | Kuhn et al. | |
| D907,509 | S | 1/2021 | Stadelmaier et al. | |
| D908,015 | S | 1/2021 | Stadelmaier et al. | |
| 10,934,049 | B2 | 3/2021 | Brandenburger et al. | |
| 11,096,866 | B2 | 8/2021 | Spallek et al. | |
| 2006/0032865 | A1* | 2/2006 | Ophardt | B65D 1/0292 222/94 |
| 2010/0189934 | A1 | 7/2010 | Brandenburger et al. | |
| 2010/0206892 | A1 | 8/2010 | Mast | |
| 2011/0240673 | A1 | 10/2011 | Araujo et al. | |
| 2014/0305952 | A1* | 10/2014 | Harris | B65D 1/0292 220/666 |
| 2018/0251254 | A1* | 9/2018 | Groot | B65D 23/003 |
| 2019/0038508 | A1 | 2/2019 | Spallek et al. | |
| 2020/0079545 | A1 | 3/2020 | Soehnlen et al. | |
| 2020/0189169 | A1 | 6/2020 | Brandenburger et al. | |
| 2020/0231323 | A1 | 7/2020 | Ito et al. | |
| 2020/0324932 | A1 | 10/2020 | Ito et al. | |
| 2021/0030216 | A1 | 2/2021 | Ophardt et al. | |
| 2021/0139185 | A1 | 5/2021 | Tanaka | |

FOREIGN PATENT DOCUMENTS

| | | | |
|---|---|---|---|
| EP | 2167393 | B1 | 6/2011 |
| EP | 2209605 | B1 | 9/2014 |
| EP | 2259976 | B1 | 11/2014 |
| EP | 3122644 | B1 | 3/2018 |
| EP | 3359460 | A1 | 8/2018 |
| EP | 2517966 | B1 | 9/2018 |
| EP | 2938546 | B1 | 9/2018 |
| EP | 3166863 | B1 | 9/2018 |
| EP | 2678233 | B1 | 12/2018 |
| EP | 3049234 | B1 | 11/2019 |
| EP | 3423024 | B1 | 12/2019 |
| EP | 3340959 | B1 | 3/2020 |
| EP | 3771389 | A1 | 2/2021 |

OTHER PUBLICATIONS

EP Design Registration No. 000335443-0008, Tetra Laval Holdings & Finance S.A., registered Apr. 27, 2005.
EP Design Registration No. 001758889-0001, Nestec, S.A., registered Sep. 23, 2020.
EP Design Registration No. 001792185-0001, Beauty Brands Concept, registered Dec. 10, 2010.
EP Design Registration No. 001802109-0001, H.J. Heinz Foods UK Limited, registered Jan. 6, 2011.
EP Design Registration No. 001802109-0002, H.J. Heinz Foods UK Limited, registered Jan. 6, 2011.
EP Design Registration No. 001802109-0003, H.J. Heinz Foods UK Limited, registered Jan. 6, 2011.
EP Design Registration No. 002149385-0001, L'Occitane International S.A., registered Dec. 7, 2012.
EP Design Registration No. 002710905-0001, Werner & Mertz GmbH, registered Jun. 1, 2015.
EP Design Registration No. 005637790-0001, Persan, S.A., registered Sep. 12, 2018.
EP Design Registration No. 007983275-0001, Obrist Closures Switzerland GmbH, registered Jun. 3, 2020.
EP Design Registration No. 008488647-0001, Saraya Poland Sp. s o.o., registered Apr. 7, 2021.
WO Design Registration No. D049261-001, Les Grands Chais de France, registered Sep. 23, 1999.
WO Design Registration No. D080099-001, Société des Produits Nestlé S.A., registered Feb. 1, 2013.
WO Design Registration No. D080099-002, Société Des Produits Nestlé S.A., registered Feb. 1, 2013.
WO Design Registration No. D080099-003, Société Des Produits Nestlé S.A., registered Feb. 1, 2013.
WO Design Registration No. D206245-001, The Procter & Gamble Company, registered Feb. 12, 2020.
WO Design Registration No. D209517-001, The Procter & Gamble Company, registered Jul. 8, 2020.
WO Design Registration No. D209517-002, The Procter & Gamble Company, registered Jul. 8, 2020.
WO Design Registration No. D209517-003, The Procter & Gamble Company, registered Jul. 8, 2020.
WO Design Registration No. D209517-004, The Procter & Gamble Company, registered Jul. 8, 2020.
WO Design Registration No. D211818-002, The Procter & Gamble Company, registered Dec. 10, 2020.
WO Design Registration No. D211850-001, The Procter & Gamble Company, registered Dec. 10, 2020.
WO Design Registration No. D211850-002, The Procter & Gamble Company, registered Dec. 10, 2020.
WO Design Registration No. D211850-003, The Procter & Gamble Company, registered Dec. 10, 2020.
WO Design Registration No. D212084-003, The Procter & Gamble Company, registered Dec. 10, 2020.
WO Design Registration No. D212084-004, The Procter & Gamble Company, registered Dec. 10, 2020.
WO Design Registration No. D212084-006, The Procter & Gamble Company, registered Dec. 10, 2020.
WO Design Registration No. D213358-004, The Procter & Gamble Company, registered Dec. 10, 2020.
International Search Report and Written Opinion for PCT/US2024/26406, mailed Aug. 27, 2024, 8 pages.

* cited by examiner

COLLAPSIBLE, HANGABLE PLASTIC BOTTLE

BACKGROUND

Enteral nutrition, i.e. tube feeding, is required when a person is unable to eat conventionally. During tube feeding, an enteral nutritional fluid is delivered from a bottle or pouch through a flexible tube that runs directly into the stomach or small intestine of the person. Accordingly, a bottle containing a nutritional fluid is applied with cap that is part of a tube feeding set and suspended upside-down, i.e. with the opening facing downward, from a drip stand. In order to enable the bottle to be suspended from a drip stand, bottles that are specially designed for tube feeding often include hanging elements on the base of the bottle. Some bottles designed for tube feeding may also be designed to collapse during emptying.

Current hangable plastic bottles are either collapsible or have a hanging element that provides a user with a desired degree of rigidity. Embodiments of the present invention are directed to a bottle that achieves both. Embodiments of the present invention are also directed to a bottle that, by way of a unique placement and arrangement of hinge lines, is configured to collapse in a manner that differs from other known collapsible bottles.

SUMMARY OF THE INVENTION

Embodiments of the present disclosure are directed to a collapsible bottle that includes a main body having a base at one end and a neck that terminates at a free edge and defines an opening to the interior of the bottle at the other end. The main body is made up of front and rear walls and left and right side walls, with the front and rear walls being wider than the left and right side walls. Each of the side walls comprises a rounded shoulder region, a lower transition region, and a central region positioned between the shoulder and the transition region. The central region is divided into a first panel and a second panel by a vertically running central hinge line. The first panel spans between the vertical central hinge line and a vertically running front hinge, which separates the first panel and the front wall of the bottle. Similarly, the second panel spans between the vertical central hinge line and a vertically running rear hinge, which separates the second panel from the rear wall of the bottle.

The bottle, and in particular the arrangement of hinge lines, is configured so that when pressure is placed on the front and rear walls of the bottle, e.g. by a user squeezing the front and rear walls of the bottle, each of the front and rear hinge lines flex inward and the central hinge line flexes outward, such that the front and rear walls collapse toward one another with the central hinge line being pushed outward away from the central axis of the bottle. When used in the present application, collapsing or controlled collapsing of the bottle refers to the condensing of the space between the front and rear walls brought about by folding along the identified hinge lines.

In embodiments of the bottle, the first panel is angled inward from the central hinge line toward the front hinge line and the second panel is angled inward from the central hinge line toward the rear hinge. In some embodiments, for instance, the angle formed between the first and second panels by the central hinge may be between about 140 degrees and about 175 degrees, alternatively between about 145 degrees and about 170 degrees, alternatively between about 150 degrees and about 170 degrees. In embodiments of the bottle, the center hinge line that divides the first and second panels fades toward the top of the central region, such that the cross-section of each of the side walls adjacent the shoulder region has a rounded, or curved, central region (as opposed to the angled central region defined by the central hinge line).

In embodiments of the bottle, each of the front and rear hinges may have a particular geometry that includes an outward-projecting rib. The rib may be made up of an apex, a convex portion that transitions from the apex into the front or rear wall, and a concave portion that transitions from the apex into the first or second panel of the side wall. In some embodiments, each of the front and rear hinges may have an outer curvature between about 135 degrees and about 165 degrees, alternatively between about 140 degrees and about 160 degrees, and/or an inner curvature between about 140 degrees and about 180 degrees, alternatively between about 145 degrees and about 175 degrees. In embodiments of the bottle, the front and rear hinges, like the central hinge line, may fade toward the top of the central region, such that the cross-section of each of the side walls adjacent the rounded shoulder region has a continuous curvature (as opposed to the more complex cross-sectional geometry defined by the central, front and rear hinge lines).

Embodiments of the bottle include a hanging element by which the bottle can be suspended in an upside-down orientation, e.g. for use in supplying enteral nutrition. The hanging element may comprise a tab having an aperture through which a hook or rod may be passed, such that a portion of the surface of the tab that defines the aperture may be supported by the hook or rod with the bottle hanging downward in an upside-down orientation. The aperture may be circular, though other shapes are contemplated without departing from the scope of the invention.

The tab may be positioned in an access channel that spans between the front and rear wall. The access channel extends upward from the base, dividing the base of the bottle into independent right and left portions. In some embodiments, the upper edge of the tab, the right edge of the tab, and the left edge of the tab (which may all be portions of a single curved edge) are all integrally connected with a lower surface of the bottle that defines the access opening. This provides the hanging element with improved rigidity. The lower edge of the tab may be positioned upward of a standing surface of the base, so as not to compromise stability of the bottle, when in a standing position.

In some embodiments, the access channel may narrow moving from the front wall to the tab and/or from the rear wall to the tab, such that the access channel has a first width and the front and/or rear wall and a second width at the tab, with the first width being greater than the second width. In some embodiments, for example, the first width may be between 120% and 150% greater than the second width.

The bottle may be configured to have a desired degree of stability when resting on the standing surface. In some embodiments, for example, the bottle may have a tilt angle of at least 12 degrees, alternatively at least 15 degrees, alternatively at least 17 degrees. The bottle may also be configured so that the base of the bottle does not deform when the walls of the bottle are collapsed.

The bottle may be configured to undergo the controlled collapse when subjected to the vacuum forces applied internally during tube feeding under typical flow-rates achieved using a conventional feeding set and a vented cap, such as the FreeGo® pump and giving set, which includes a FreeGo® Screwcap set with ENFit® medication port and connector. In some embodiments, for example, the bottle may be configured to collapse when emptied by pumping of the bottle contents through a vented cap at a rate of (i) 300 mL/hr or (ii) both 150 mL/hr and 300 mL/hr. In such embodiments, the bottle may also be configured to be manually collapsed after emptying, such as by a user applying pressure to the front and rear walls by hand (that pressure being greater than the vacuum forces achieved internally during emptying).

Alternatively, the bottle may be configured to not undergo the controlled collapse when subjected to the vacuum forces applied internally during tube feeding under typical flow-rates achieved using a conventional feeding set and a vented cap, such as the FreeGo® pump and giving set, which includes a FreeGo® Screwcap set with ENFit® medication port and connector. In some embodiments, for example, the bottle may be configured to not collapse when emptied through a vented cap at a rate of (i) 150 mL/hr or (ii) both 150 mL/hr and 300 mL/hr. In such embodiments, the bottle may instead be configured to be manually collapsed after emptying, such as by a user applying pressure to the front and rear walls by hand.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
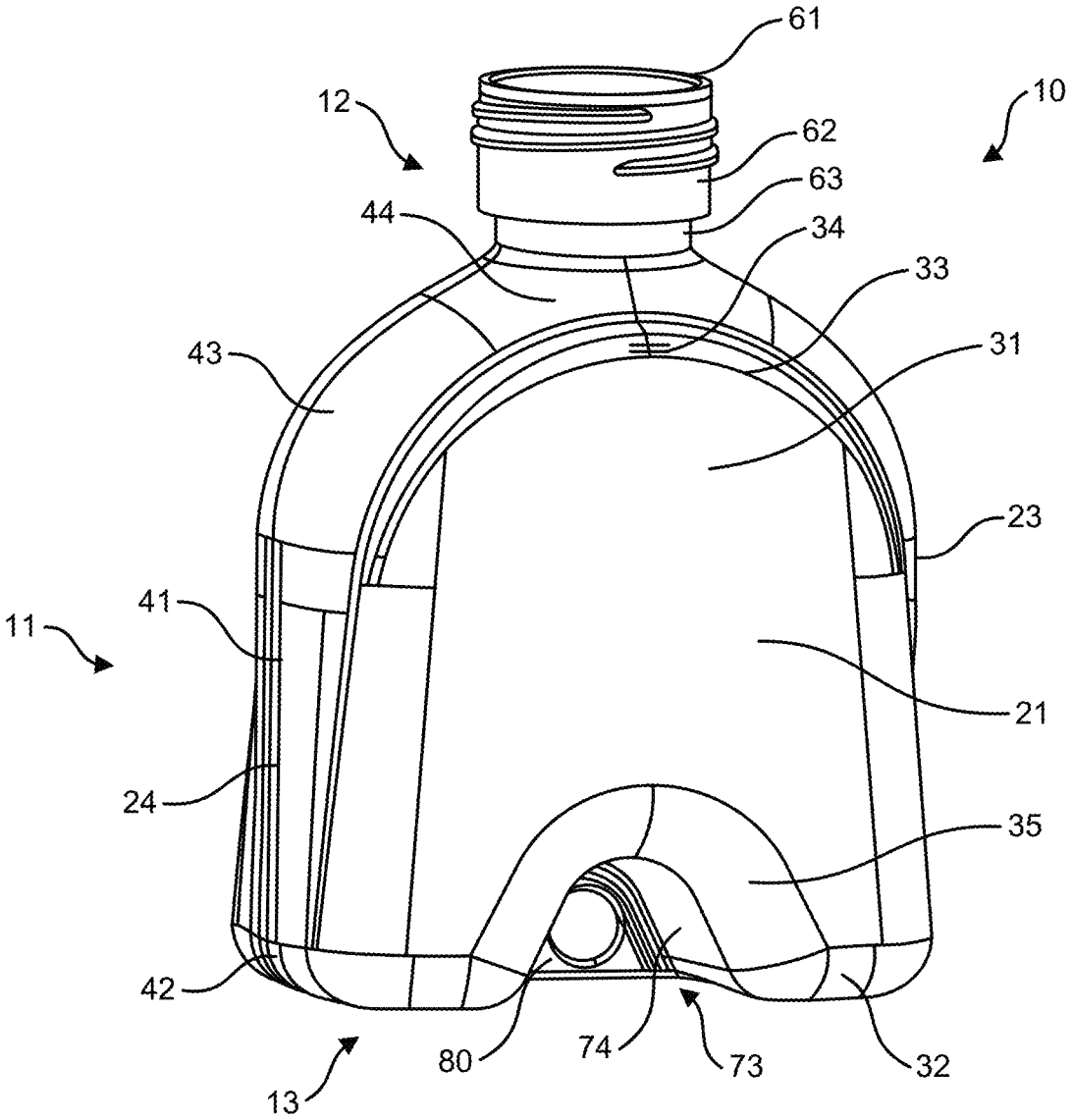
FIG. 1 is a front perspective view of a first embodiment of a bottle in accordance with the present disclosure.
Figure 2:
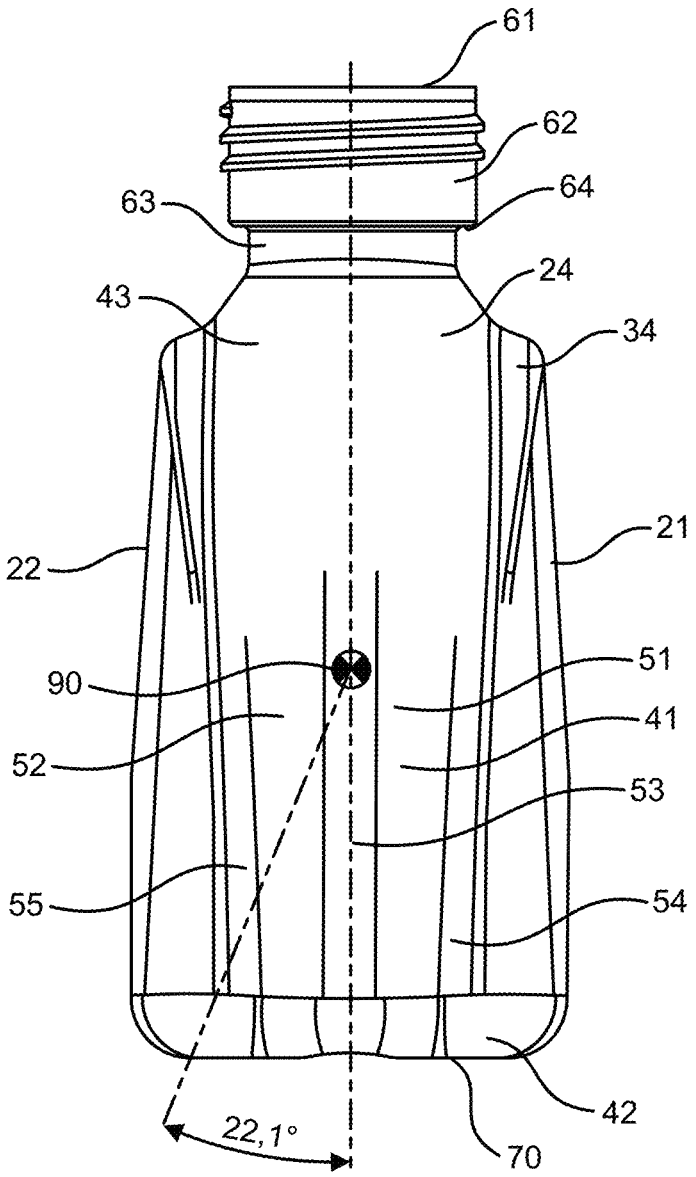
FIG. 2 is a side plan view of the embodiment shown in FIG. 1.
Figure 3:
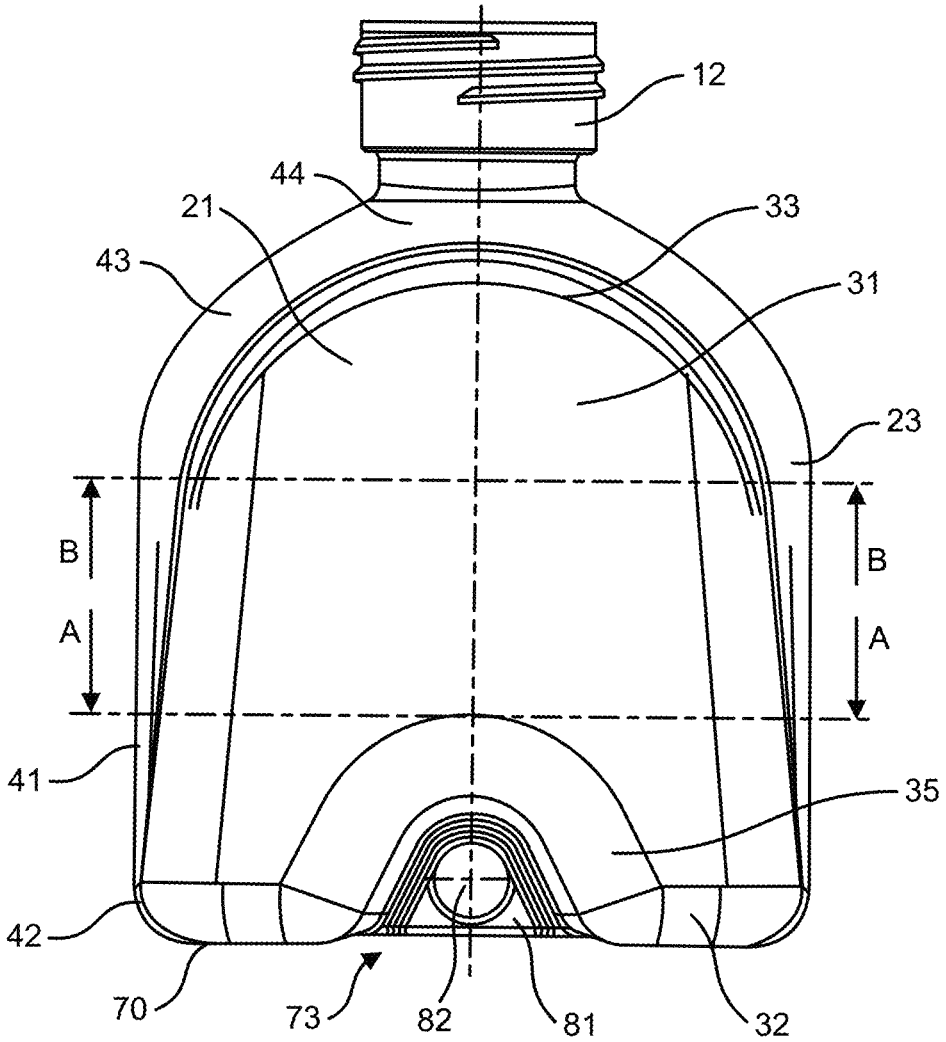
FIG. 3 is a front plan view of the embodiment shown in FIG. 1.

Embodiments of the present disclosure are directed to a bottle 10 configured to contain a liquid product, for example a nutritional product and optionally a nutritional product that may be administered via tube feeding. The bottle 10 may be made of a thermoplastic material, for example high-density polyethylene (HDPE) or a similar thermoplastic material, using methods known in the art such as extrusion blow molding or the like. The exact shape and dimensions of the bottle 10 are controlled by the volume of liquid product which the bottle is configured to contain, though regardless of the bottle volume, i.e. size, the bottles of the present disclosure include shared features that allow the bottles to be collapsible and/or hangable, as well as design elements that allow different-sized bottles to be recognized as part of the same family of products.

A first embodiment of a bottle 10 in accordance with the present disclosure is illustrated in FIGS. 1-7. That embodiment is configured to hold a relatively small volume of liquid product, as demonstrated by its relatively small dimensions and in particular its short height. Specifically, the embodiment shown in FIGS. 1-7 is configured to hold about 500 mL, i.e. 0.5 liters, of a nutritional liquid product (with a suitable headspace), though a bottle having a similar design and configured to contain alternative amounts could be prepared using the principles illustrated herein.

A second embodiment of a bottle 10 in accordance with the present disclosure is illustrated in FIGS. 8-14. That embodiment is configured to hold an intermediate volume of liquid product. In particular, the embodiment shown in FIGS. 8-14 is configured to hold about 1000 mL, i.e. 1 liter, of a nutritional liquid product (with a suitable headspace), though a bottle having a similar design and configured to contain alternative amounts could be prepared using the principles illustrated herein.

A third embodiment of a bottle 10 in accordance with the present disclosure is illustrated in FIGS. 15-21. That embodiment is configured to hold a relatively large volume of liquid product, as demonstrated by its increased height and side walls having an increased width. In particular, the embodiment shown in FIGS. 15-21 is configured to hold about 1500 mL, i.e. 1.5 liters, of a nutritional liquid product (with a suitable headspace), though a bottle having a similar design and configured to contain alternative amounts could be prepared using the principles illustrated herein.

Each bottle 10 is made up generally of a main body portion 11, a neck finish 12, and a base 13. The main body 11 comprises two opposing major walls, referred to herein as the front wall 21 and the rear wall 22, and two opposing minor walls, referred to herein as the right side wall 23 and left side wall 24. The width of the right side wall 23 and the left side wall 24 is less than the width of the front wall 21 and the rear wall 22, hence the designation of the side walls as minor and the front/rear walls as major.

In the illustrated embodiments, the front wall 21 and the rear wall 22 are identical or substantially identical, meaning that one cannot visually distinguish between the two. In other (non-illustrated) embodiments, however, the front wall 21 may have slight differences from the rear wall 22 in order to visually distinguish between the front and the rear of the bottle 10.

Each of the front wall 21 and the rear wall 22 comprises a main outer surface 31 that is, at least in primary part, substantially flat and smooth, which allows an adhesive label to be securely attached thereto. By substantially flat it is meant that the outer surfaces of the front and rear walls 21, 22 need not be perfectly flat, in which case they would be parallel with one another, but may instead each have a slightly convex curvature. In the embodiments illustrated in FIGS. 1-21, the entirety of the outer surfaces of the front wall 21 and rear wall 22 are substantially flat and smooth. In alternative (non-illustrated) embodiments, however, each of the front and rear walls 21, 22 may comprise one or more indentations configured to receive the fingers or thumb of a user in order to provide a gripping region.

Figure 22:
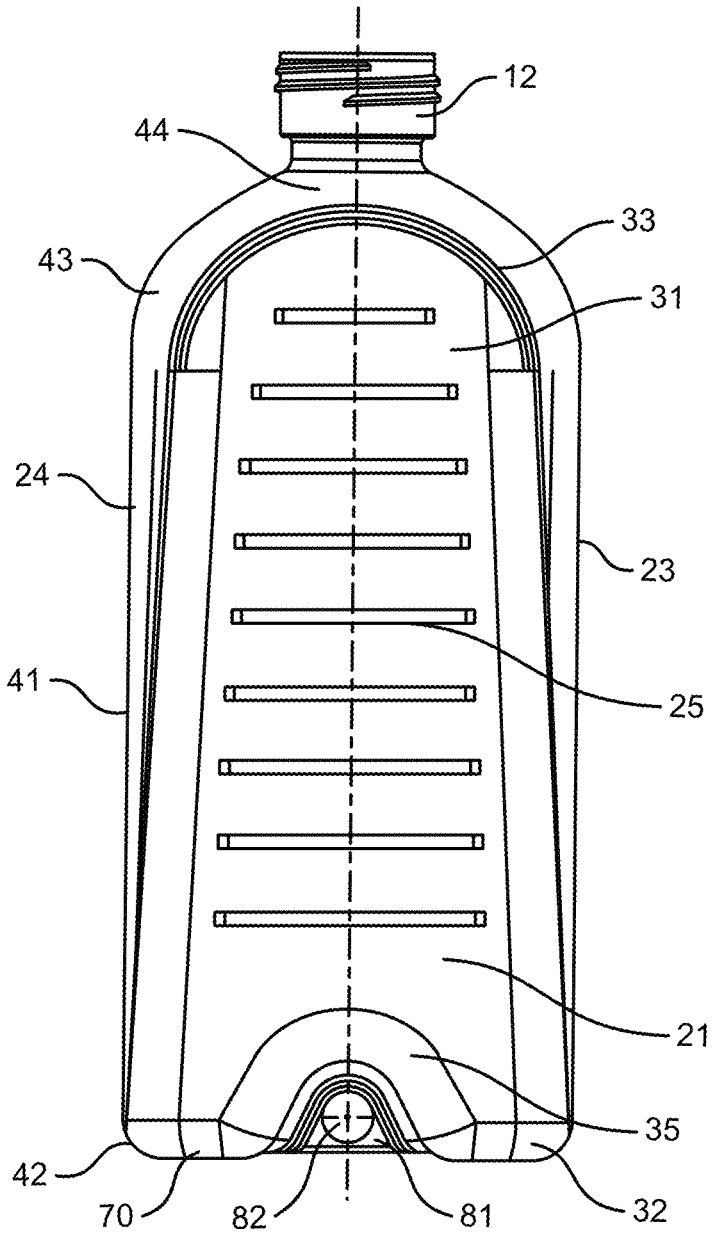
FIG. 22 is a front plan view of an alternative version of the embodiment shown in FIG. 15, comprising a series of ribs on each of the front and rear walls.

Further, in some embodiments, such as that illustrated in FIG. 22, the main outer surface 31 of each of the front and rear walls 21, 22 may include one or more ribs 25. The one or more ribs 25 may be configured to provide each of the front and rear walls 21, 22 with enhanced strength and rigidity, which may reduce bulging of the front and rear walls to thereby enable secure attachment of an adhesive label. Each of the one or more ribs 25 may be an inward-extending rib that runs horizontally across at least a central portion of the wall 21, 22. The exact geometry (e.g. curvature, width, depth) of each rib, as well as the number of ribs present on each wall, may be selected and designed to provide the wall with a desired degree of rigidity. In the illustrated embodiment, for example, the front wall 21 of the bottle 10 is shown having nine ribs 25, though the number and geometry of the ribs in the illustrated embodiment is not limiting and each could easily be altered by a person of skill in the art. As the size of a bottle increases, the potential for bulging of the front and rear walls 22 increases, so the inclusion of ribs 25 is particularly contemplated for bottles 10 that are configured to hold larger volumes of liquid product such as the 1500 ml bottle illustrated in FIG. 22 or larger bottles.

Each of the front wall 21 and the rear wall 22 also comprises a lower transition region 32, which transitions the main surface 31 to the base 13. As illustrated, the lower transition region 32 is desirably curved. In some embodiments, including all of the illustrated embodiments, the lower transition region 32 may be interrupted by an access channel 73 for a hanging element, as is described in greater detail elsewhere. In the illustrated embodiments, for example, the lower transition region 32 may therefore include a central arched portion 35 that transitions from the main surface 31 of the front or rear wall 21, 22 into the surface 74 that defines the access channel 73. The curvature of the arched portion 35 of the transition region 32 may differ from the curvature of the portions of the transition region on either side of it.

In some embodiments, including all of the illustrated embodiments, each of the front wall 21 and the rear wall 22 may also comprise an arched upper edge 33. The arched upper edge 33 is a characteristic that is shared across each of the illustrated embodiments and which provides each bottle with a similar appearance such that the set of bottles can be identified as being related to one another. The curvature of the arched upper edge 33 may correspond with that of the rounded shoulder portion of the bottle, which is described in greater detail elsewhere. Further, as shown in the illustrated embodiments, the arched upper edge 33 may extend outward from the rounded shoulder portion of the bottle, thereby creating an upper ledge 34 that is positioned a distance below the neck finish 12 of the bottle 10. This too is a characteristic that is shared across each of the illustrated embodiments and which provides each bottle with a similar appearance such that the set of bottles can be identified as being related to one another.

Each of the right side wall 23 and the left side wall 24 comprises a central region 41, a lower transition region 42, and a rounded upper shoulder 43. The central region 41 of each side wall 23, 24 is positioned between the lower transition region 42 and the rounded upper shoulder 43. Further, the central region 41 is configured to collapse in a controlled, accordion-like manner (a) when a user puts pressure on the front and rear walls 21, 22 of the empty bottle, (b) in response to vacuum forces created during a controlled emptying, e.g. utilizing a vented or unvented lid that is connected to a tube feeding set, or (c) both (a) and (b).

The pressure that may be placed on the front and rear walls 21, 22 of an empty bottle 10 by a user is significantly greater than the vacuum forces acting on the interior of the bottle during a controlled emptying, i.e. feeding, meaning that the bottle may have a relatively high rigidity and still be collapsible via mechanism (a). In contrast, the rigidity of the bottle must be relatively lower in order to provide for collapse via mechanism (b). Accordingly, some embodiments of the bottle 10 may be collapsible by mechanism (a) but not mechanism (b), whereas other embodiments of the bottle 10 may be collapsible by both mechanism (a) and mechanism (b). The thickness of the bottle walls 21, 22, 23, 24 may be selected and controlled in order to provide a desired compromise between rigidity and collapsibility.

The central region 41 comprises a first panel 51 and a second panel 52, which are divided by a central hinge 53 that runs along a longitudinal axis of the bottle. The first panel 51, which is positioned forward of the central hinge 53, borders against and is separated from the front wall 21, and more particularly the main surface 31 of the front wall, by a front hinge 54. The second panel 52, which is positioned rearward of the central hinge 53, borders against and is separated from the rear wall 22, and more particularly the main surface 31 of the rear wall, by a rear hinge 55. In sum, the central region 41 of each of the right and left side walls 23, 24 comprises three hinges—a central hinge 53, a front hinge 54, and a rear hinge 55.

Figure 23:
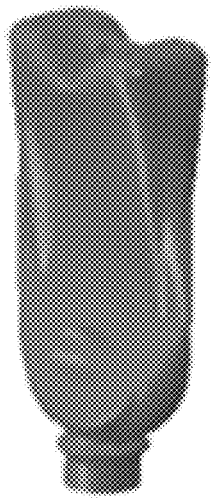
FIG. 23 is a front perspective view of an embodiment of a bottle in accordance with the present disclosure in a collapsed configuration.
Figure 24:
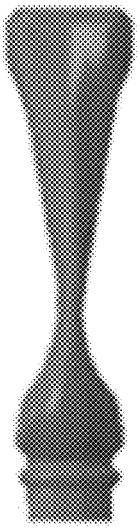
FIG. 24 is a side plan view of the embodiment shown in FIG. 23 in a collapsed configuration.

When the bottle 10 collapses, the front hinge 54 and the rear hinge 55 each flexes inward and the central hinge 53 flexes outward, such that the front wall 21 and the rear wall 22, and more particularly the main surfaces 31 of the front and rear walls, move inward toward one another and the central hinge 55 is pushed outward away from the front and rear walls 21, 22. An example of this controlled, accordion-like collapse is illustrated in FIGS. 23 and 24. As shown in FIGS. 23 and 24, when the bottle 10 is brought to a collapsed configuration, the neck finish 12 and the base 13 of the bottle are not substantially deformed. Indeed, in some embodiments, the bottle 10 may still rest stably on the base 13 even when in a collapsed configuration. Further, in some embodiments the rounded shoulder 43 is also not substantially deformed when the bottle 10 is brought to a collapsed configuration.

The central region 41 of the right side and left side walls 23, 24, and in particular the features which allow the bottle 10 to collapse in the manner described and shown herein, will now be described in greater detail.

In some embodiments, including all of the illustrated embodiments, the central hinge 53 extends a first lateral distance from the center line of the bottle (running between the front and rear walls 21, 22) and each of the first and second panels 51, 52 is angled inward from the central hinge 53 to either the front hinge 54 or the rear hinge 55, which extends a second lateral distance from the center line of the bottle, with the second lateral distance being less than the first lateral distance. In particular, the first panel 51 may be angled inward running from the central hinge 53 to the front hinge 54 and the second panel 52 may be angled inward running from the central hinge 53 to the rear hinge 55.

Figure 5:
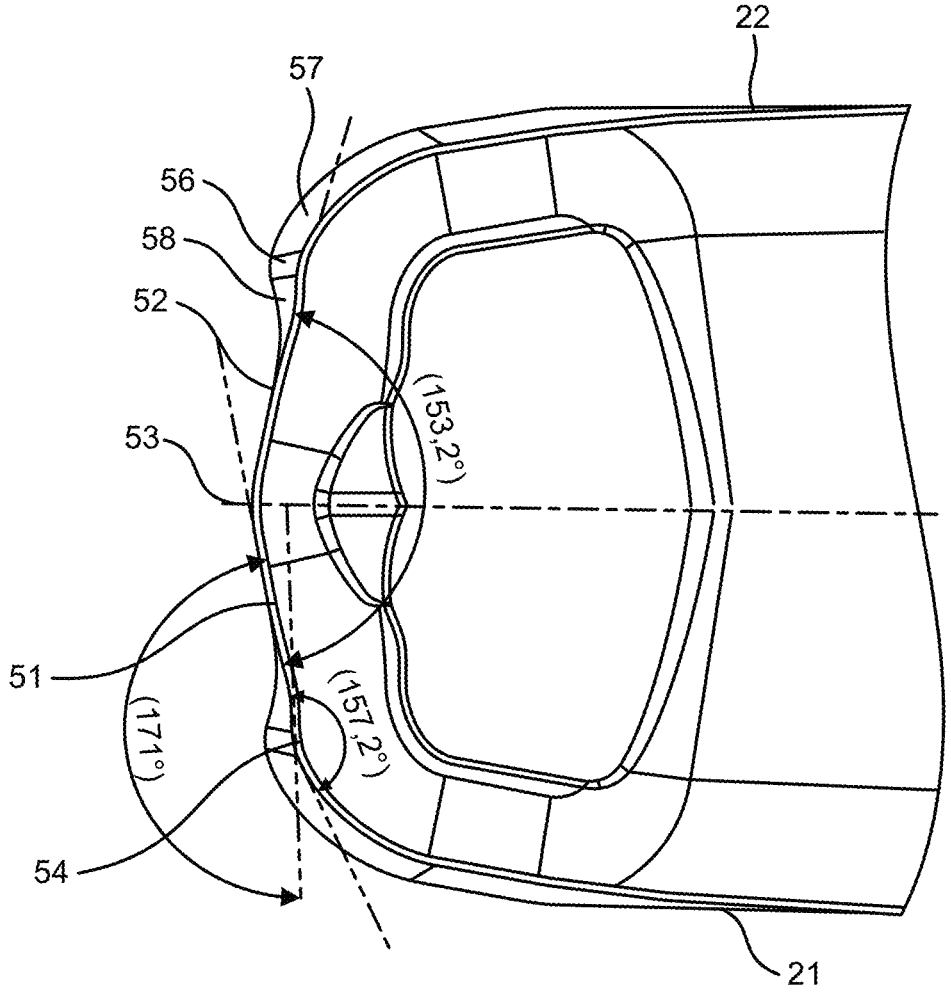
FIG. 5 is a partial cross-sectional view taken along line A-A in FIG. 3.
Figure 6:
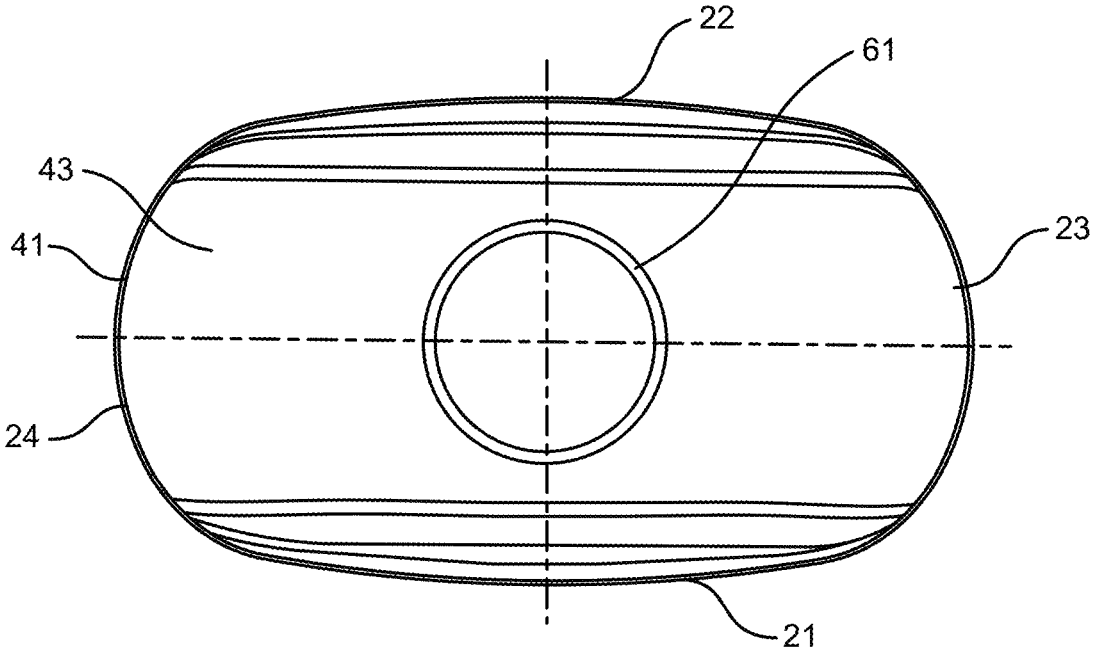
FIG. 6 is a cross-sectional view taken along line B-B in FIG. 3.
Figure 7:
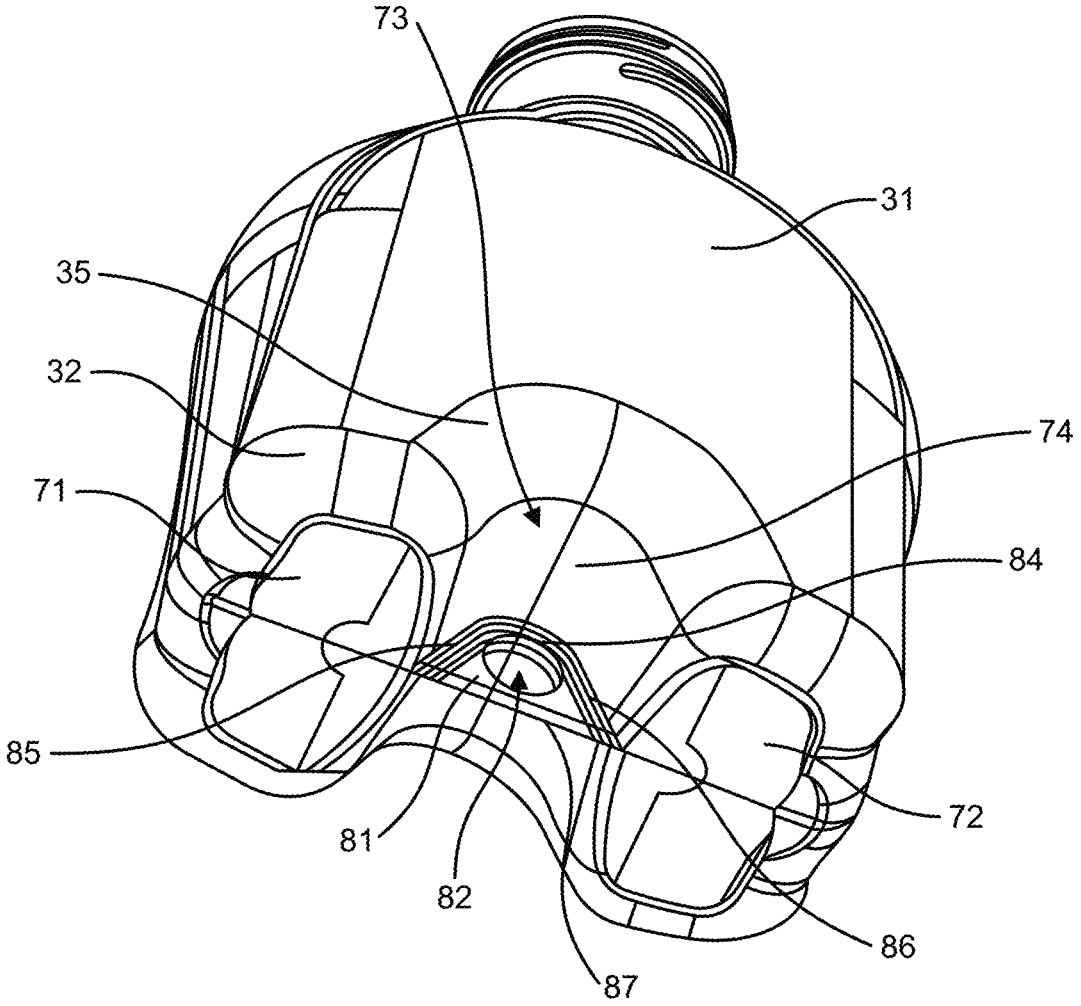
FIG. 7 is a bottom, rear perspective view of the embodiment shown in FIG. 1.
Figure 8:
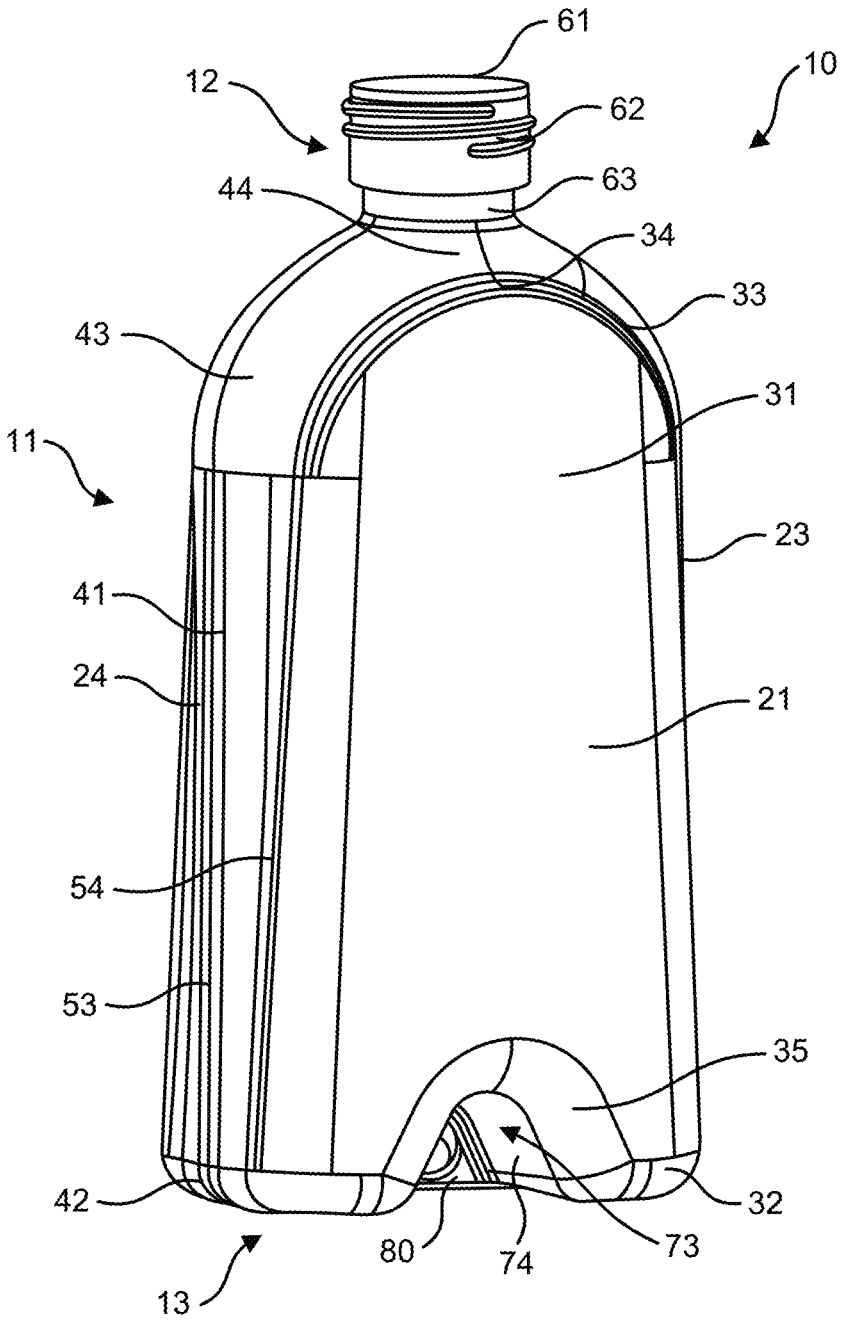
FIG. 8 is a front perspective view of a second embodiment of a bottle in accordance with the present disclosure.
Figure 9:
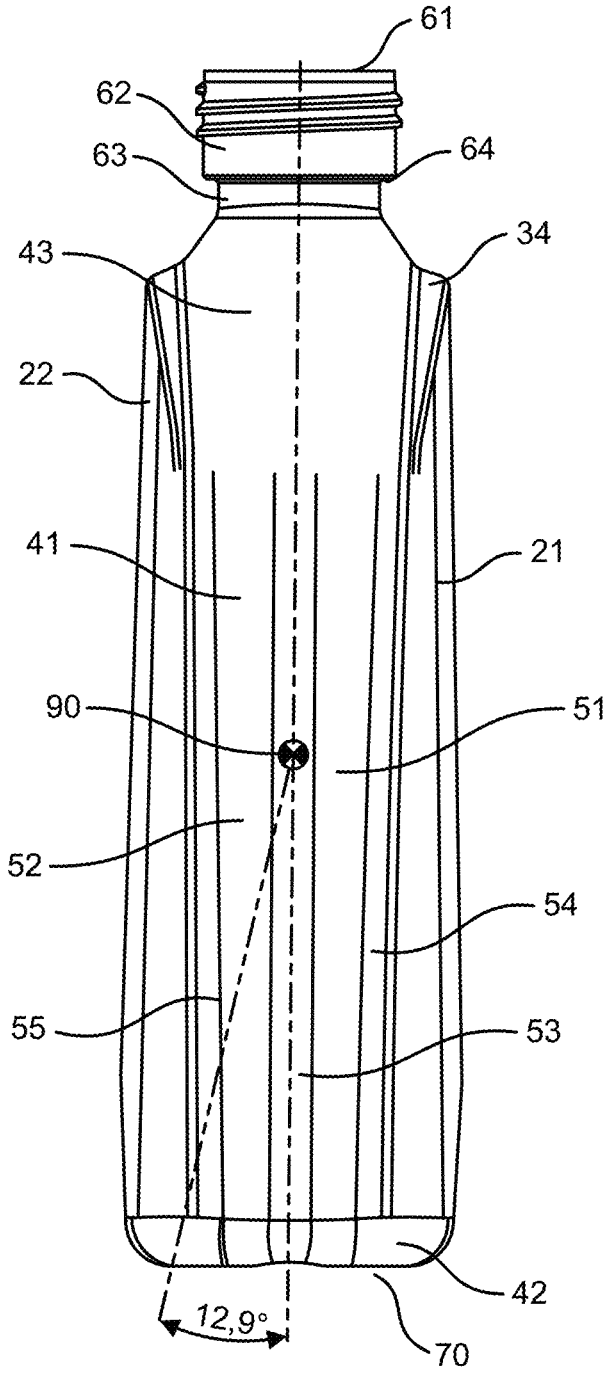
FIG. 9 is a side plan view of the embodiment shown in FIG. 8.
Figure 10:
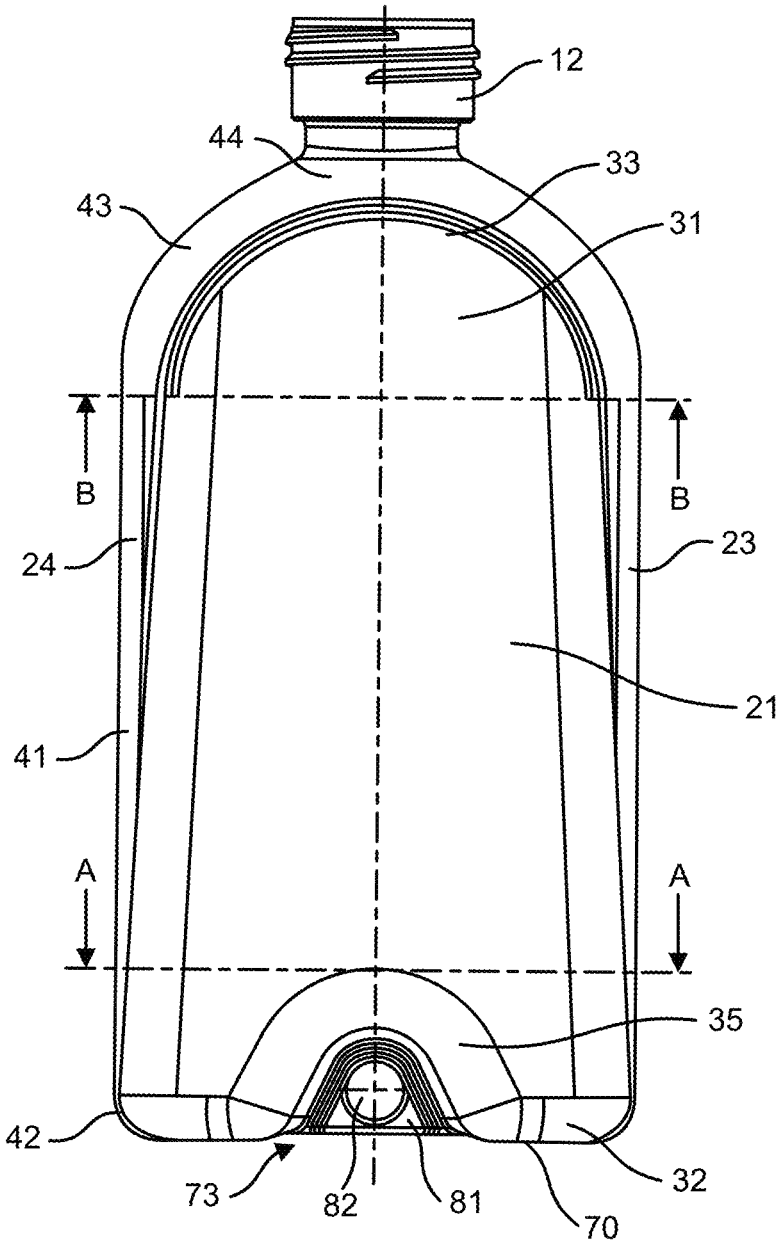
FIG. 10 is a front plan view of the embodiment shown in FIG. 8.
Figure 12:
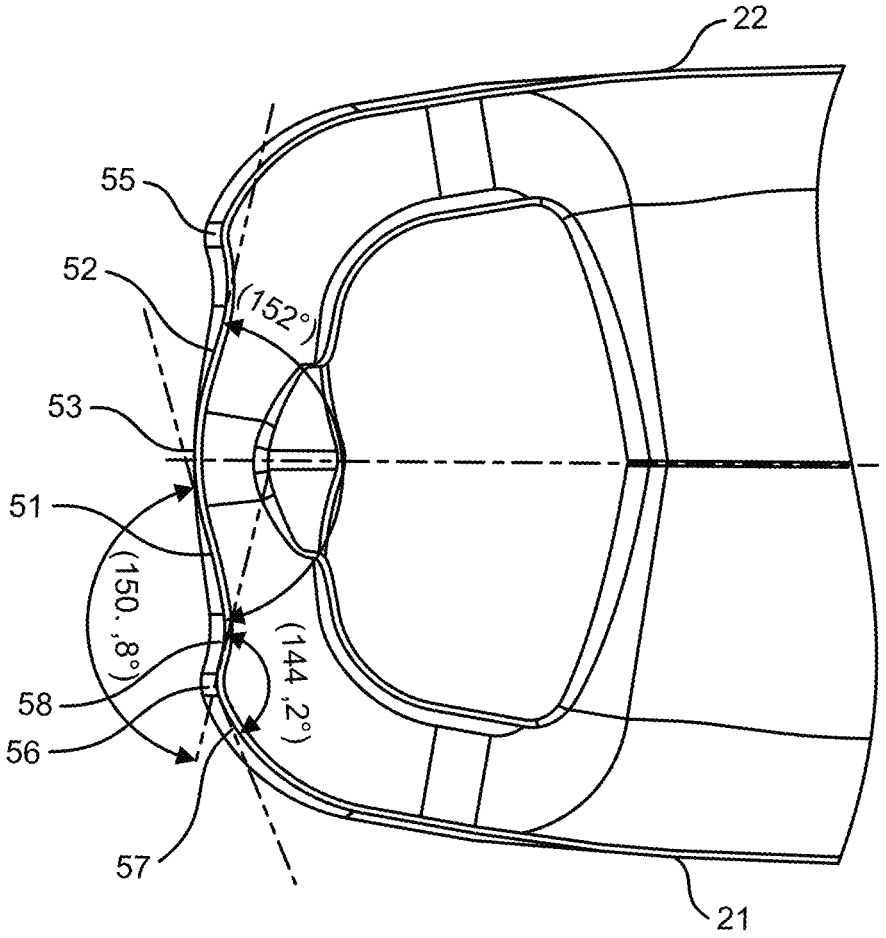
FIG. 12 is a partial cross-sectional view taken along line A-A in FIG. 10.
Figure 19:
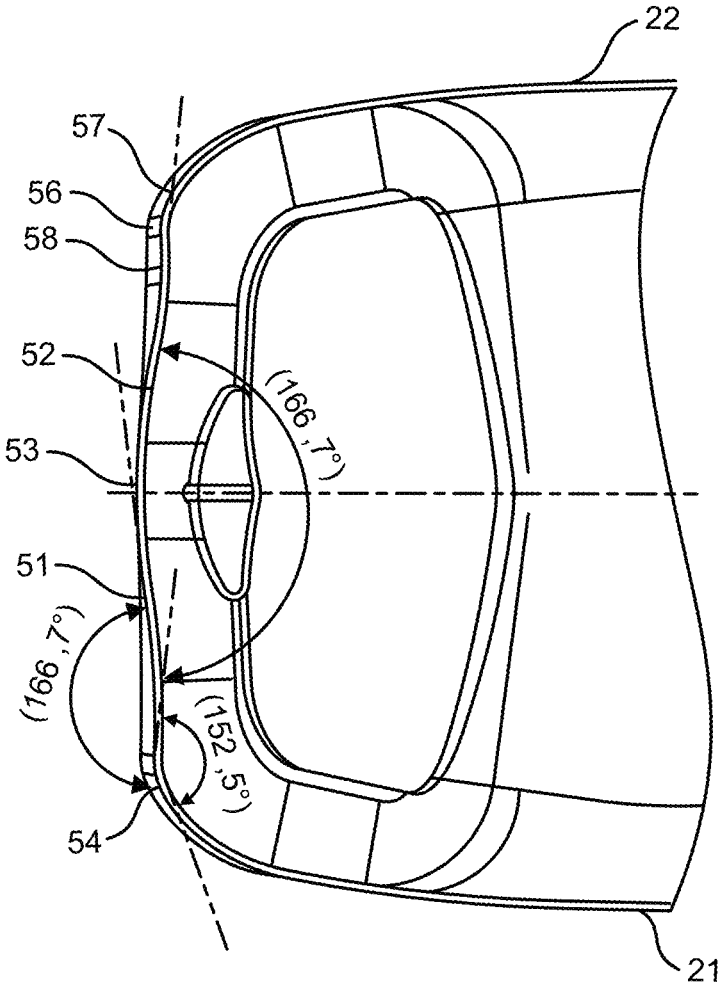
FIG. 19 is a partial cross-sectional view taken along line A-A in FIG. 17.
Figure 20:
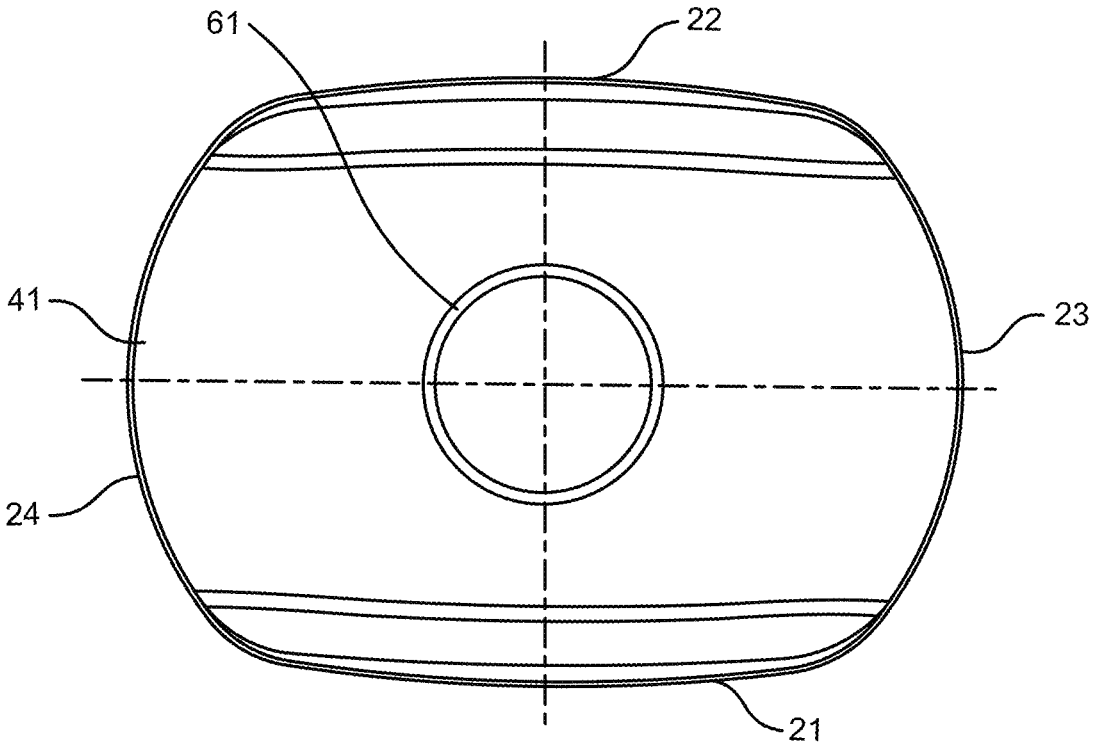
FIG. 20 is a cross-sectional view taken along line B-B in FIG. 17.
Figure 21:
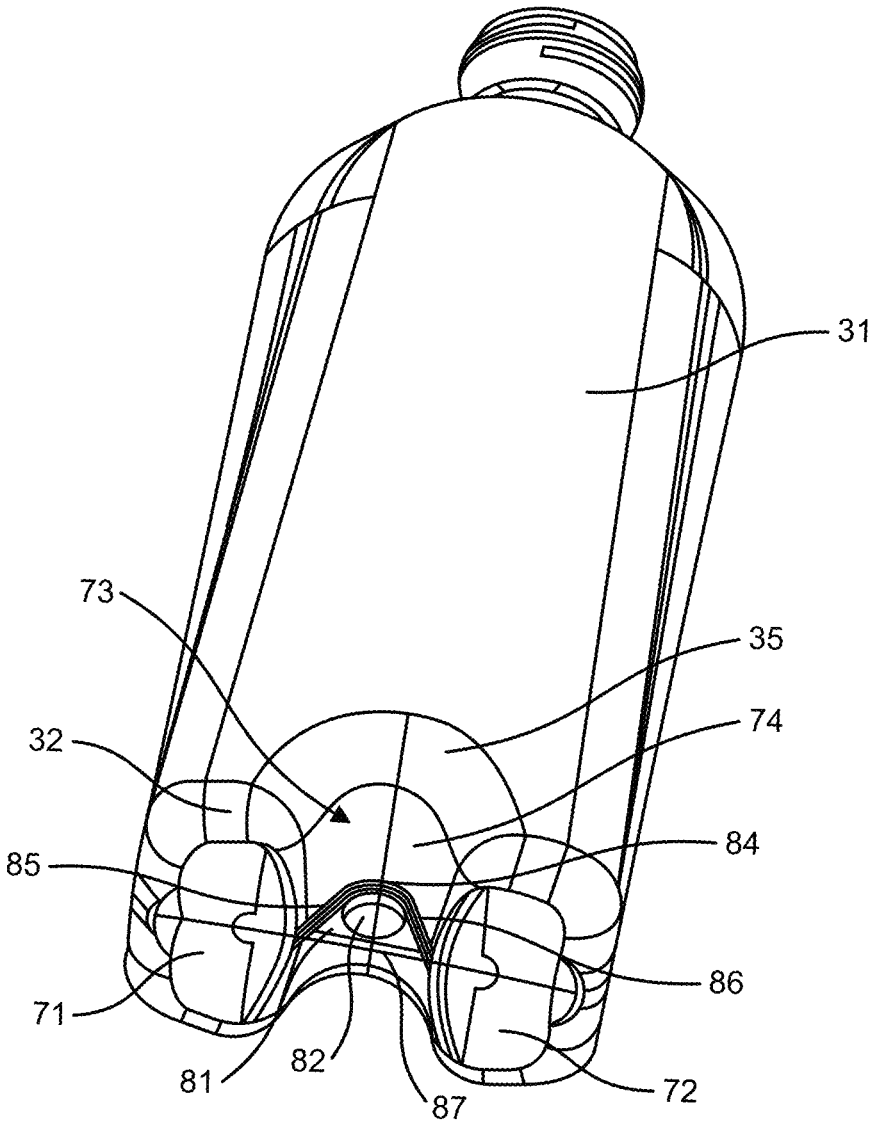
FIG. 21 is a bottom, rear perspective view of the embodiment shown in FIG. 15.

An example of the angular nature of the first and second panels 51, 52 can be seen in FIGS. 5, 12, and 19. The degree of incline, or slope, of each of the angular panels 51, 52 may be fairly small. In some embodiments, the bottle 10 may comprise first and second panels 51, 52, which each form one or more angles with an axis that runs laterally between the front and rear walls that is/are between about 4 degrees and about 18 degrees, alternatively between about 5 degrees and about 16 degrees, alternatively between about 6 degrees and about 15 degrees. As shown in the embodiment illustrated in FIG. 12, for instance, at the location where the cross-section was taken, the angle formed between the first panel 51 and the second panel 52 is about 152 degrees, meaning that the angle formed between each panel and an axis that runs laterally between the front and rear walls is about 14 degrees (determined by subtracting 152 degrees from 180 degrees and then dividing by 2). By keeping the slope of the first and second panels 51, 52 fairly small, the right and left side walls 23, 24 are prevented from having an undesirable triangular appearance while still providing the side walls with a geometry that enables the controlled, accordion-like collapse described herein.

Put another way, the central hinge 53 may form an angle between about 140 degrees and about 175 degrees, alternatively between about 145 degrees and about 170 degrees, alternatively between about 150 degrees and about 170 degrees. In the embodiment illustrated in FIG. 12, for example, the central hinge 53 forms an angle of about 152 degrees. In the embodiment illustrated in FIG. 19, on the other hand, the central hinge 43 forms an angle of about 166 degrees. As can be seen by a comparison of the figures, the side walls 23, 24 are provided with a flatter appearance as the angle of the central hinge 53 gets closer to 180 degrees. The exact angle or angles of the central hinge 53 may be selected in order to provide the bottle with a desired combination of collapsibility and desirable appearance.

Figure 13:
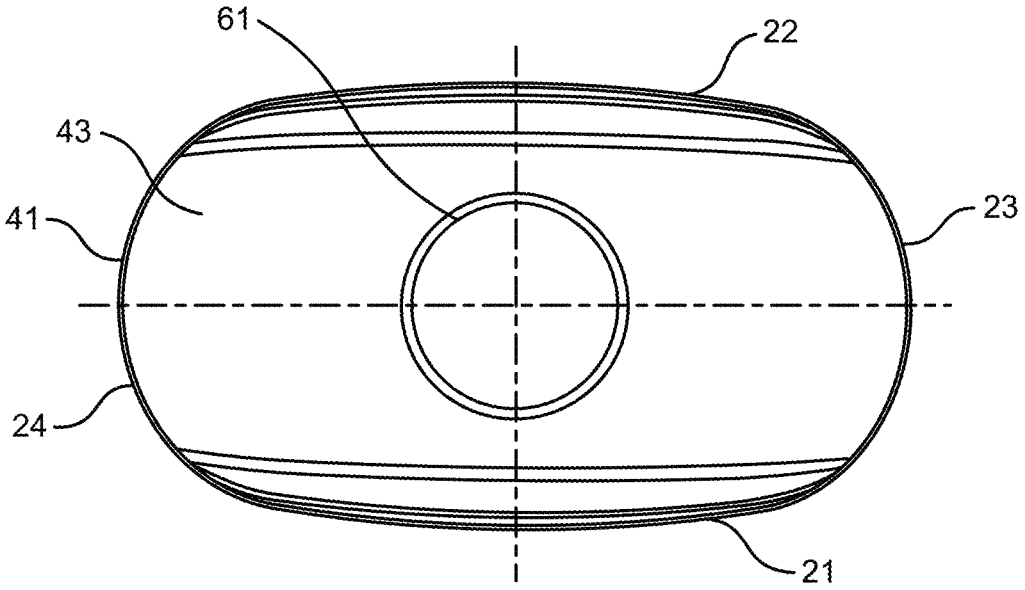
FIG. 13 is a cross-sectional view taken along line B-B in FIG. 10.
Figure 14:
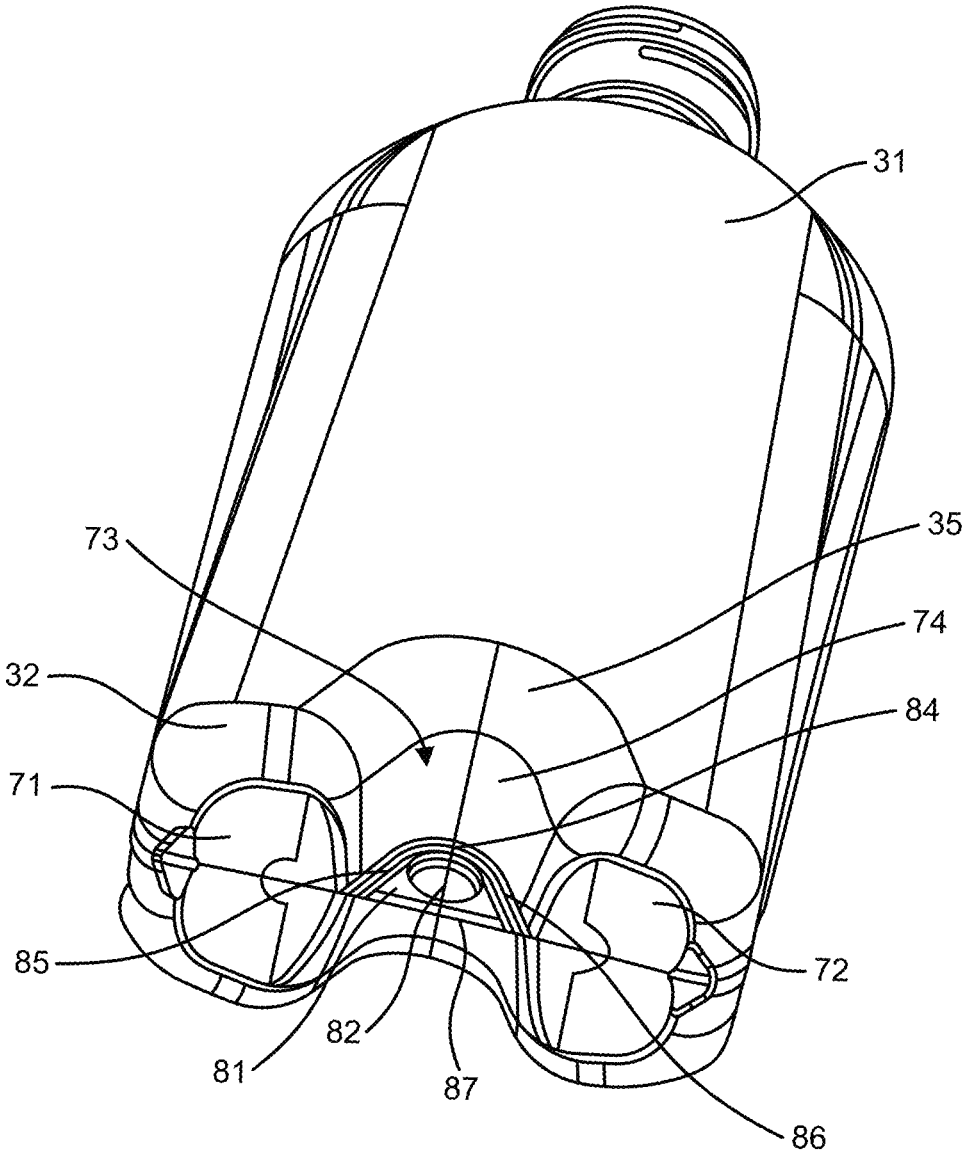
FIG. 14 is a bottom, rear perspective view of the embodiment shown in FIG. 8.
Figure 15:
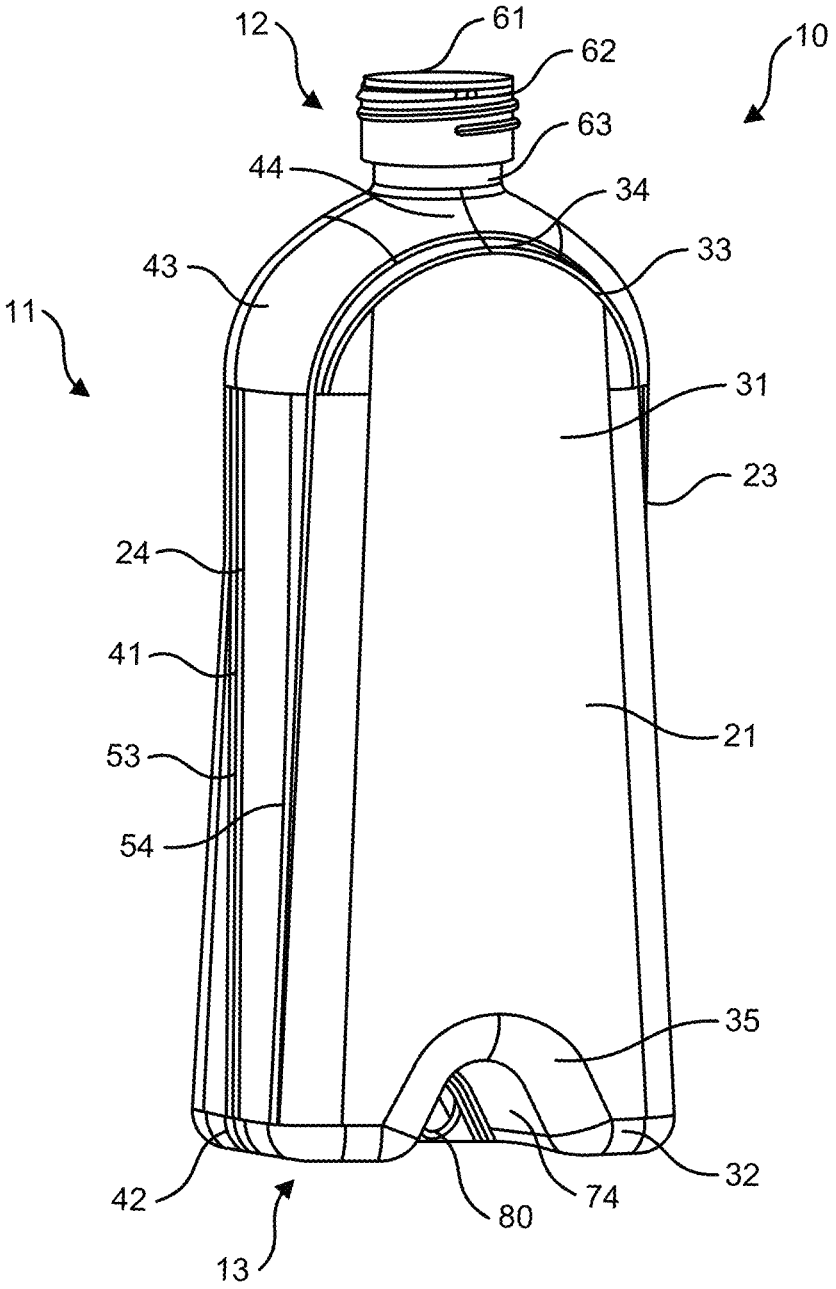
FIG. 15 is a front perspective view of a second embodiment of a bottle in accordance with the present disclosure.
Figure 16:
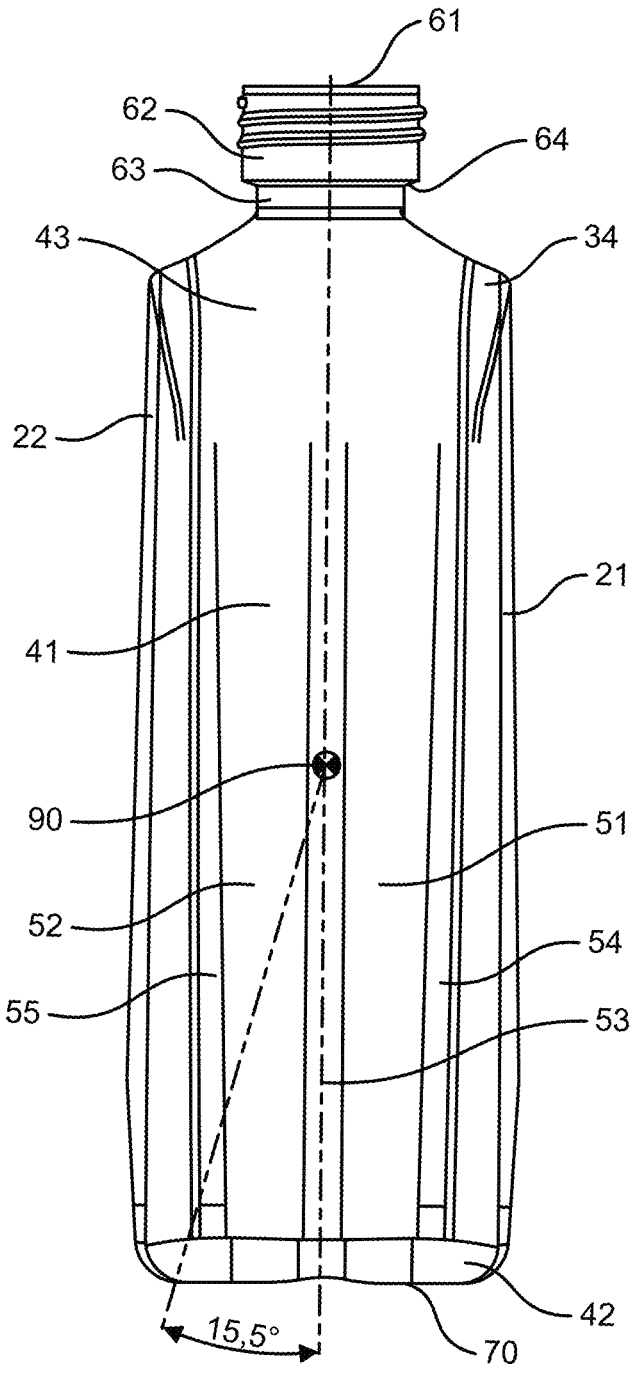
FIG. 16 is a side plan view of the embodiment shown in FIG. 15.
Figure 17:
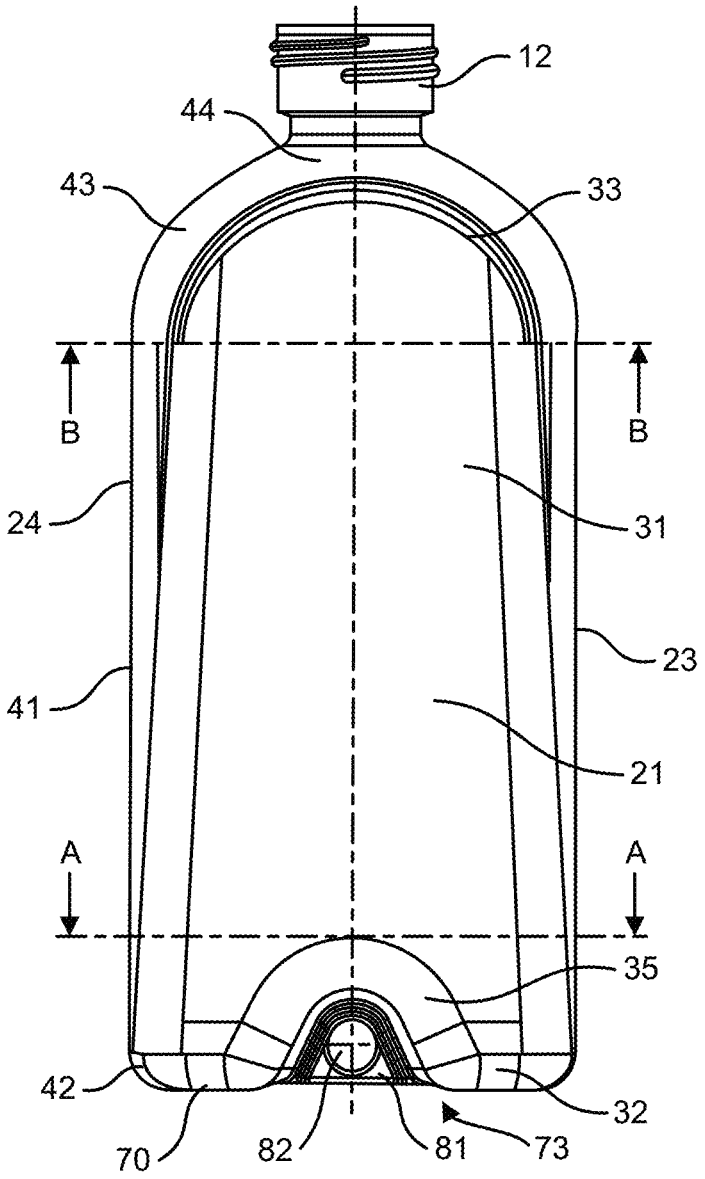
FIG. 17 is a front plan view of the embodiment shown in FIG. 15.

In some embodiments, including the illustrated embodiments, the central hinge 53 may fade and optionally cease toward the top of the central region 41, i.e. in the area of the central region closest to the rounded shoulder 43. This effect can be seen, for example, by comparing the cross-section of the side wall shown in FIG. 12, taken along line A-A of FIG. 10, with the cross-section of that same side wall shown in FIG. 13, taken along line B-B of FIG. 10. As can be seen in the Figures, the central hinge 53, which in lower regions (such as shown in FIG. 12) formed a clear division between first panel 51 and second panel 52 which acted as a hinge point, may fade such that at the top of the central region 41 the first and second panels merge into a single continuous panel having a curved cross-sectional profile (such as is shown in FIG. 13).

Each of the front hinge 54 and the rear hinge 55 comprise an outward-projecting rib 56. The outermost point of the rib 56 is referred to as the apex. The front hinge 54 comprises a convexly curved transition portion 57 between the main surface 31 of the front wall and the apex of the rib 56. The front hinge 54 also comprises a concave transition portion 58 between the first panel 51 and the apex of the rib 56. Similarly, the rear hinge 55 comprises a convexly curved transition portion 57 between the main surface 31 of the rear wall and the apex of the rib 56 and a concave transition portion 58 between the second panel 52 and the apex of the rib. Examples of each of these portions of the front and rear hinges 54, 55 can be seen, for example, in any of FIG. 5, 12, or 19.

The outer curvature of the rib 56 and the inner curvature of the rib may each be varied to provide the hinge with a desired action during collapse. The outer curvature of the rib 56 is defined as the angle formed between transition portion 57 and transition portion 58. The inner curvature of the rib 56 is defined as the angle formed between transition portion and the adjacent panel 51 or 52. Examples of the outer curvature and inner curvature of rib 56 can be seen, for example, in any of FIG. 5, 12, or 19.

In some embodiments, the rib 56 may comprise an outer curvature between about 135 degrees and about 165 degrees, alternatively between about 140 degrees and about 160 degrees. In the embodiment illustrated in FIG. 12, for example, the outer curvature of each rib 56 is about 144 degrees. In some embodiments, the rib 56 may comprise an inner curvature between about 140 degrees and about 180 degrees, alternatively between about 145 degrees and about 175 degrees. In the embodiment illustrated in FIG. 12, for example, the inner curvature of each rib 56 is about 150 degrees.

In some embodiments, including the illustrated embodiments, each of the front hinge 54 and the rear hinge 55 may also fade and optionally cease toward the top of the central region 41, i.e. in the area of the central region closest to the rounded shoulder 43. This effect can also be seen, for example, by comparing the cross-section of the side wall shown in FIG. 12, taken along line A-A of FIG. 10, with the cross-section of that same side wall shown in FIG. 13, taken along line B-B of FIG. 10. As can be seen in the Figures, the rib 56 present in lower regions (such as that shown in FIG. 12) has been flattened, such that a transition between the side wall and the front wall and a transition between the side wall and the rear wall each has a single curved cross-sectional profile (as shown in FIG. 13) in place of the apex, convex portion 57 and concave portion 58 present in lower regions (such as that shown in FIG. 12).

Where the central hinge 53, the front hinge 54, and the rear hinge 55 all fade and optionally cease near the upper end of the central region 41, the result is a bottle that, in the region adjacent the shoulder portion 43 has both a right side wall 23 with a single continuous curvature and a left side wall 24 with a single continuous curvature. Depending on the degree of flatness or outward curvature of the front and rear walls 21, 22, as well as the difference in width between the major walls and the minor walls, in some embodiments the result may be a bottle that, viewed from above, has an ovular appearance.

Each of the right side wall 23 and the left side wall 24 also comprises a lower transition region 42, which transitions the central region 41 to the base 13. As illustrated, the lower transition region 42 is desirably curved. Each side of the lower transition region 42 of the right and left side walls 23, 24 may desirably transition into the lower transition region 32 of either the front or rear side walls 21, 22.

Each of the right side wall 23 and the left side wall 24 also comprises an upper shoulder 43. As shown in the illustrated embodiments, the upper shoulder 43 may be rounded, i.e. curved inward, to provide the top of the bottle with a distinctive arched appearance. The upper shoulder 43 of the right side wall 23 and the upper shoulder of the left side wall 24 may each extend from the central region 41 of the side wall to the neck finish 12, which is positioned centrally at the upper end of the bottle. The upper shoulder 43 of the right side wall 23 and the upper shoulder of the left side wall 24 may also each comprise portions 44 that extend frontward and rearward of the neck finish 12 and which merge into one another, desirably seamlessly, to provide the top of the bottle with a continuous curvature that is interrupted centrally by the neck finish 12.

As described above, at least one of the front wall 21 and the rear wall 22, and optionally both, may comprise an arched upper edge 33 having a curvature that corresponds with the curvature of the rounded shoulder portions 43 and which extends frontward or rearward from the rounded shoulder portions 43, including portions 44, to form a small upper ledge 34.

The neck finish 12 of the bottle extends upward to a circular upper edge which forms an opening to the interior of the bottle. In some embodiments, a removable foil seal (not illustrated) may be provided over top of the upper edge 61 of the neck finish 12, e.g. in order to provide a substantially airtight seal, as is well understood in the art. The neck finish 12 of the bottle further preferably comprise one or more screw threads which is/are configured to mate with the female screw threads of a cap that covers the upper edge of the bottle and any foil seal that may be attached thereto. In some embodiments, the neck finish 12 of the bottle may further comprise an outward-extending ring (not illustrated) positioned below the screw threads and configured to retain a tamper-evident band that is configured to separate from a cap upon first removal of the cap from the bottle, as is well-known in the art.

In some embodiments, including the illustrated embodiments, the neck finish 12 of the bottle may comprise an upper region 62 and a lower region 63, with the upper region having a greater cross-sectional diameter than the lower region such that a ledge 64 is formed between the two. In some embodiments, the upper and lower regions 62, 63 of the neck finish 12 may be configured so that a tamper-evident band that remains on the neck finish of the bottle upon removal of a cap falls into the lower region 63 when the cap is removed. This may be particularly useful where the bottle is configured for tube feeding, as the ledge 64 created by the greater-diameter upper region 62 may prevent the tamper-evident band from moving onto or past the upper region 62, whereby it could interfere with a feeding set or the like upon inversion of the bottle and/or hanging of the bottle in the inverted orientation.

The base 13 of the bottle comprises a lower surface on which the bottle is configured to stand, also referred to as a standing surface 70. In the illustrated embodiments, the lower surface is divided into a first portion 71 and a second portion 72 by a central channel 73, also referred to as an access channel. The first and second portions 71, 72 may be identical in shape and dimensions (each portion may of course have one or more different tags, such as the resin identification code, RIC). In some embodiments, the bottle may configured such that the base 13 of the bottle does not deform when the bottle is collapsed.

The central channel 73 is defined by an inner surface 74, which, as shown in the illustrated embodiments, may be curved. The central channel 73 extends between the front and rear walls 21, 22, such that each of the front and rear walls comprises a central arch 35 where the transition region 32 transitions into the inner surface 74 of the channel, as is described above.

A hanging element 80 is positioned within the central channel 73. The hanging element 80 comprises a rigid plastic tab 81 that defines a hanging aperture 82. The hanging aperture 82 extends through the tab between the front and rear faces of the bottle. As shown in the illustrated embodiments, the hanging aperture 82 may be circular, though other shapes are contemplated without departing from the scope of the present disclosure.

The rigid plastic tab 81 may be integral with an inner surface 74 of the central channel 73. In the illustrated embodiment, for instance, the upper edge 84 of the tab 81 extends from the inner surface 74 of the central channel 73. The curvature of the upper edge 84 of the tab 81 corresponds with the curvature of the inner surface 74 of the central channel 73, such that the upper edge 84 of the tab 81 curves seamlessly into the left and right edges of the tab 85, 86, and each of the upper, left, and right edges of the tab are integrally connected with and extend from the inner surface 74 of the central channel 73. This provides the tab 81 with an improved rigidity when compared with conventional hanging tabs, whether foldable or fixed, having only an upper edge that is integrally connected to and/or extends from the body of the bottle.

The lower edge 87 of the tab 81 is a free edge. The lower edge 87 of the tab 81 desirably extends between the first and second portions 71, 72 of the base. The lower edge 87 of the tab 81 is desirably positioned upward of the standing surface 70, so as not to reduce the stability of the bottle in a standing position. The distance between the lower edge 87 of the tab 81 and the standing surface 70 of the bottle may, however, be very small such that in a standing orientation, little or no gap is visually apparent between the lower edge 87 of the tab and the standing surface 70 of the bottle.

In some embodiments, including those illustrated, the hanging element 80 is fixed, meaning that unlike some conventional hangable bottles, the tab 81 is not connected to the bottle via a hinge and does not pivot between an extended position (for hanging) and an unexpected position (for storing). The incorporation of a fixed tab 81 is considered an improvement over hinged tabs, which have been known to unintentionally pivot to an extended position at undesirable times, such as when the bottles are on filling or transport lines, thereby reducing bottle stability. That said, embodiments that include a hinged hanging tab 81, such as is known in the art, are contemplated without departing from the scope of the present disclosure.

In some embodiments, the central channel 73 may have a consistent width between the first portion 71 and the second portion 72 of the base. However, that width must be selected to balance the competing interests of having a relatively wide channel 73 so that a user may easily insert a hanger into the channel (and have a visual line of sight to the hanging element 80) and of having a relatively narrow channel so that a user may easily push the hanger through the hanging aperture 82.

In other embodiments, including the illustrated embodiments, the width of the central channel 73 may be varied in order to provide a user with an improved hanging experience by achieving both goals. In particular, the channel 73 may narrow moving inward from the front and rear walls 21, 22.

Specifically, the central channel 73 may comprise a first width 75 at the front and rear walls 21, 22 of the bottle and a second width 76 at the central of the channel, where the tab 81 resides, with the first width being greater than the second width. By providing a channel 73 that narrows moving toward the centrally-positioned tab 81, a user attempting to insert a hanger, e.g. hook, through the hanging aperture 82 will find it easy to insert the hanger into the channel 73, which is relatively wide, and then will be guided by the narrowing inner wall 74 of the channel toward the hanging aperture 82, which is positioned at the narrowest point of the channel.

Figure 4:
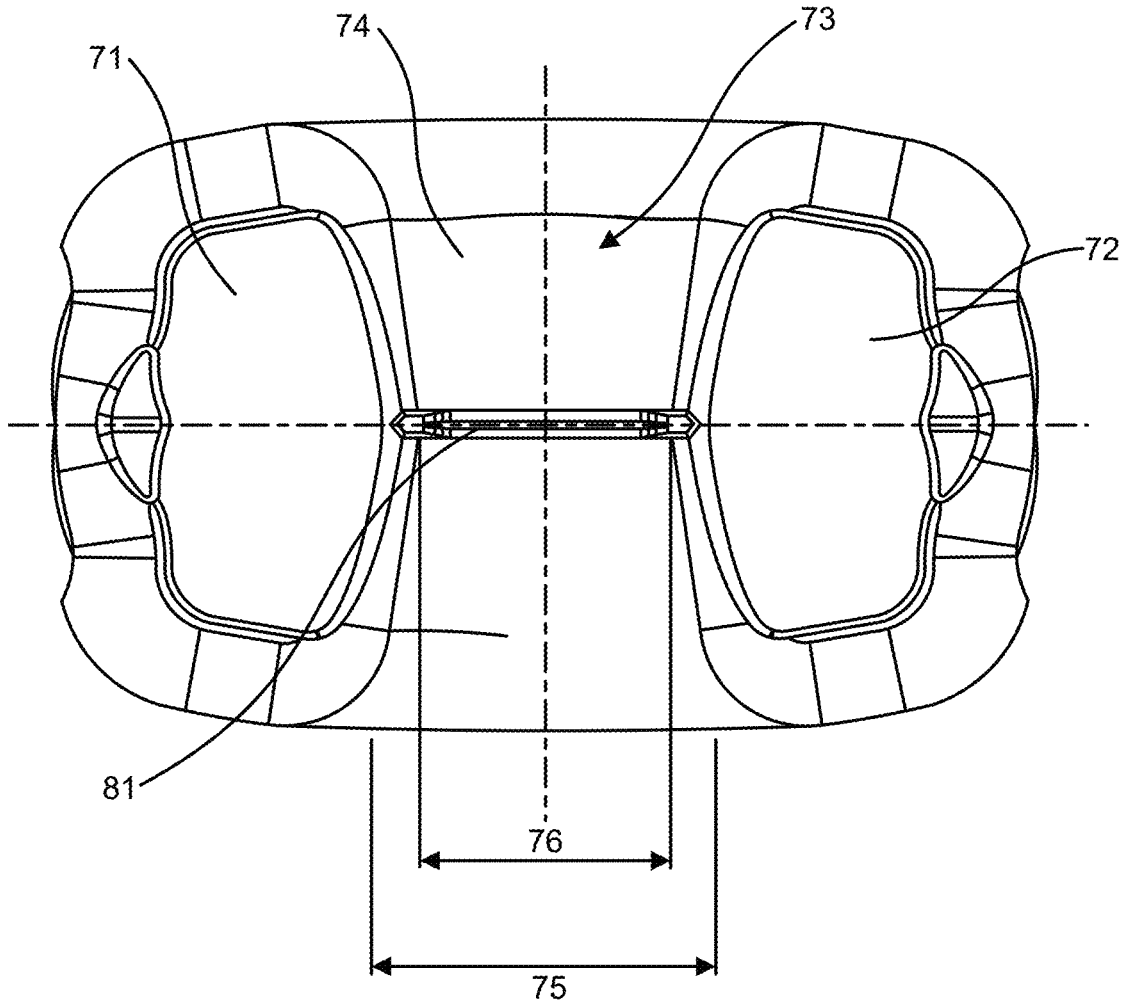
FIG. 4 is a bottom elevation view of the embodiment shown in FIG. 1.
Figure 11:
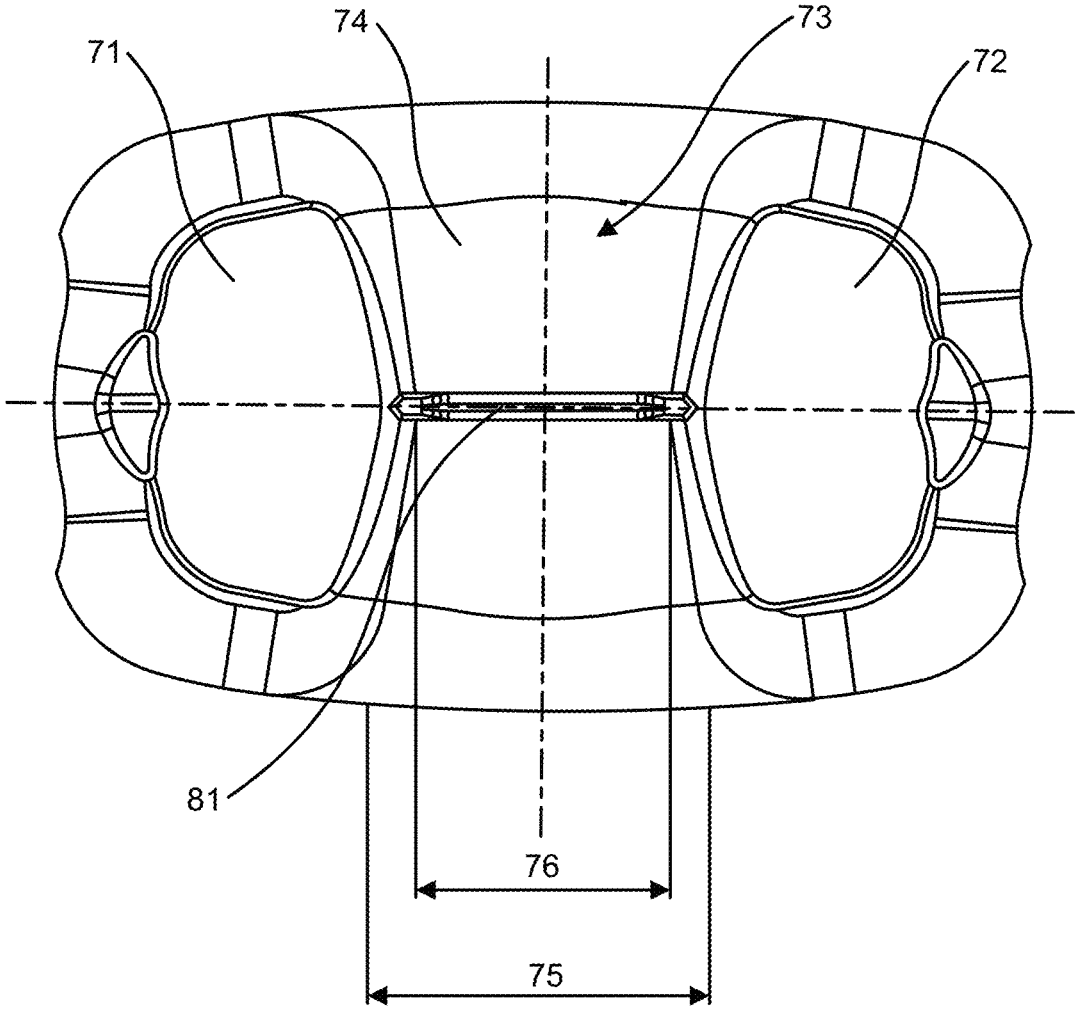
FIG. 11 is a bottom elevation view of the embodiment shown in FIG. 8.
Figure 18:
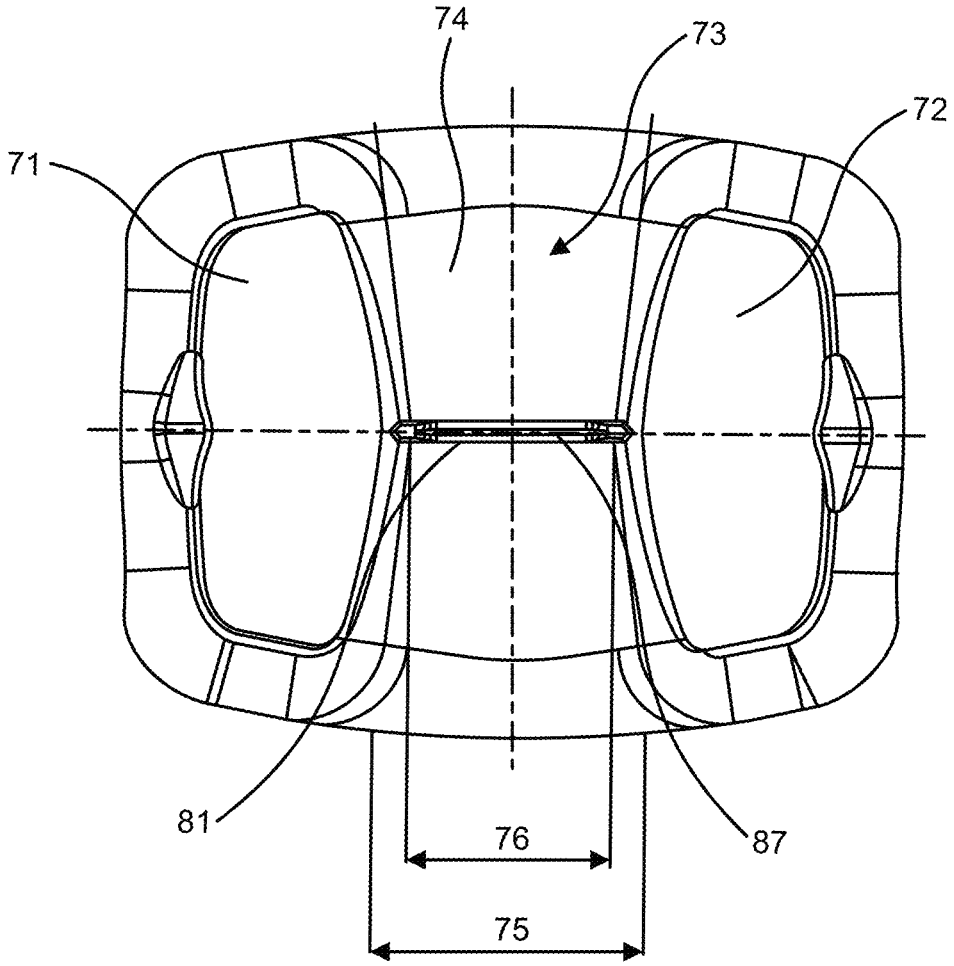
FIG. 18 is a bottom elevation view of the embodiment shown in FIG. 15.

This narrowing of the access channel 73 can be seen, for example, in FIGS. 4, 11, and 18. The degree of narrowing of the channel 73 may be selected to provide the desired effect. In some embodiments, the first width 75 may be between 120% and 150% greater than the second width 76. In each of the illustrated embodiments, for example, the first width 75 is about 136% greater than the second width 76 (the first width being about 37.5 mm and the second width being about 27.5 mm).

The bottle may also be configured to have high stability when in a standing position, which is important during filling and transporting lines and the like. One way to measure the stability of the bottle is by its tilt angle. The tilt angle is a theoretical value that is calculated by measuring the angle of two lines drawn downwards from the theoretical Center of Mass (or Gravity) 90. The first line is drawn straight down and normal to the standing surface 70 of the bottle. The second line is drawn to connect the Center of Mass 90 to the furthest point of contact of the bottle's base to the surface it is resting on, i.e. to the outer edge of the standing surface of the bottle. The tilt angle is calculated for empty bottles, only taking into consideration the weight of the plastic. Because stability is lowest in the minor axis direction, i.e. an axis running through the left and right side walls 23, 24, tilt angle of the bottles is measured on those walls, as shown for example in FIGS. 2, 9, and 16. A higher tilt angle represents a more stable bottle.

In some embodiments, the tilt angle may be increased by having the front and rear walls 21, 22 angle inward moving upward from the base. This angling of the front and rear walls 21, 22 causes the bottle, when viewed from the left and right sides, to have a greater width at the portion of the wall adjacent the base of the bottle than at the top of the bottle, as can seen for instance in FIGS. 2, 9, and 16. By angling the walls 21, 22 in this manner, the center of gravity 90 of the bottle can be lowered, thereby increasing the tilt angle of the bottle. The angling of the front and rear walls 21, 22 in this manner also creates space between bottles that are stood adjacent one another, which has the additional benefit of helping prevent adhesive labels of a bottle, which may be applied to the front and/or rear walls, from unintentionally sticking to an adjacent bottle, such as during shipping.

Embodiments of the present bottle may have a tilt angle of at least 10 degrees, alternatively at least 11 degrees, 12 degrees, alternatively at least 13 degrees, alternatively at least 14 degrees, alternatively at least 15 degrees, alternatively at least 16 degrees, alternatively at least 17 degrees, alternatively at least 18 degrees, alternatively at least 19 degrees, alternatively at least 20 degrees.

In some embodiments, the bottle may be configured such that the bottle has a desirable emptying time when allowed to bolus feed (free flow) under gravity, when used with a conventional venting cap. Specifically, in some embodiments, the bottle may be configured to bolus feed at a rate of 500 mL/7-10 minutes. The bottle should also desirably be configured to fully drain.

EXAMPLE 1

Samples of 0.5 liter and 1.0 liter bottles, such as those shown in the illustrated embodiments, were filled with Osmolite® 1.0 Cal, available from Abbott, to the stated volume, applied with the FreeGo® Screwcap set with ENFit® medication port and connector (S790), available from Abbott, and hung from a drip stand. Each of the bottles was then allowed to bolus feed (free flow) on a gravity system. The testing was completed at ambient temperature, i.e. about 20° C. The samples delivered product at a rate of 500 mL in seven to ten minutes and each sample fully drained.

Embodiments of the bottle may also be configured to have a desired ease of collapsibility. In some embodiments, the bottle may be configured such that emptying of the bottle with a vented cap under conventional pump settings, such as 150 mL/hr and/or 300 mL/hr (e.g. using a FreeGo® pump), does not cause collapse of the bottle. In other embodiments, the bottle may be configured such that emptying of the bottle with a vented cap under those same conventional pump settings does cause collapse of the bottle. The ease of collapsibility can be controlled by varying the weight of the bottle. Where the weight of the bottle is relatively low, the bottle may be configured such that emptying of the bottle under conventional pump settings such as 150 mL/hr and 300 mL/hr causes collapse of the bottle. Where the weight of the bottle is raised, however, the bottle may be configured such that emptying of the bottle under those conventional pump settings does not cause collapse of the bottle. In those embodiments, the bottle may be manually collapsed after emptying, such as a by a user manually applying pressure to the front and rear walls.

EXAMPLE 2

Samples of 1.0 liter bottles, such as those shown in the illustrated embodiment, were filled with Jevity® 1.5 Cal, available from Abbott, to the stated volume, applied with the FreeGo® Screwcap set with ENFit® medication port and connector (S790), available from Abbott. A FreeGo® pump and associated giving set (i.e. tube feeding set) was connected to each of the bottles. Each bottle was then hung from a drip stand and the nutritional fluid contents of the bottle were pumped through the giving set at a flowrate of 150 mL/hr until the bottle was emptied. The testing was completed at ambient temperature, i.e. about 20° C. At the end of the testing, the bottles were visually inspected to determine whether they collapsed fully in response to the vacuum forces present inside the bottle during emptying.

Though the geometry and dimensions of the sample bottles were consistent, the sample bottles were produced having three different wall thicknesses, giving the bottles three different weights: 35 g, 40 g, and 45.5 g. Five samples of each bottle were tested. Of the five 35 g bottles, all five collapsed fully during tube feeding at 150 mL/hr. Of the five 40 g bottles, two of the five collapsed fully during tube feeding at 150 mL/hr. Of the five 45.5 g bottles, none of the five collapsed fully during tube feeding at 150 mL/hr. This testing demonstrates that the collapsibility of the bottles may be controlled by controlling the bottle strength (i.e. material weight). As the bottle strength is increased, the level of collapse decreases.

It can be seen that the described embodiments provide unique and novel bottles 10 that have a number of advantages over those in the art. While there is shown and described herein certain specific structures embodying the invention, it will be manifest to those skilled in the art that various modifications may be made without departing from the spirit and scope of the underlying inventive concept and that the same is not limited to the particular embodiments herein shown and described except insofar as indicated by the scope of the appended claims.

What is claimed:

1. A collapsible bottle comprising:

a base;

a neck that defines an opening;

a front wall;

a rear wall;

left and right side walls, each of the left and right side walls comprising a rounded shoulder region that transitions to the neck, a lower transition region that transitions into the base, and a central region positioned between the rounded shoulder region and the lower transition region, the central region comprising a first panel and a second panel, the first and second panels being divided by a substantially vertical central hinge, the first panel being divided from the front wall by a front hinge, and the second panel being divided from the rear wall by a rear hinge;

wherein, when pressure is placed on the front and rear walls of the bottle, the front hinge line flexes inward, the rear hinge line flexes inward, and the central hinge flexes outward, such that the front and rear walls collapse toward one another with the central hinge being pushed outward away from the front and rear walls;

wherein the first panel is angled inward from the central hinge toward the front hinge and the second panel is angled inward from the central hinge toward the rear hinge; and wherein the angle formed between the first and second panels by the central hinge is between about 140 degrees and about 175 degrees.

2. The collapsible bottle of claim 1, wherein the angle formed between the first and second panels by the central hinge is between about 150 degrees and about 170 degrees.

3. The collapsible bottle of claim 1, wherein the center hinge fades toward the top of the central region such that each of the left and right side walls has a curved cross-section adjacent the rounded shoulder region.

4. The collapsible bottle of claim 1, wherein each of the front hinge and the rear hinge comprises an outward-projecting rib.

5. The collapsible bottle of claim 4, wherein the rib of the front hinge comprises an apex, a convex portion that transitions from the apex into the front wall, and a concave portion that transitions from the apex into the first panel; and the rib of the rear hinge comprises an apex, a convex portion that transitions from the apex into the rear wall, and a concave portion that transitions from the apex into the second panel.

6. The collapsible bottle of claim 5, wherein each of the front and rear hinges has (a) an outer curvature between about 135 degrees and about 165 degrees;

(b) an inner curvature between about 140 degrees and about 180 degrees; or (c) both a and b.

7. The collapsible bottle of claim 5, wherein the central, front, and rear hinges each fades toward the top of the central region such that each of the left and right side walls has a continuously curved cross-section adjacent the rounded shoulder region.

8. The collapsible bottle of claim 1, wherein each of the front and rear walls has an upper arched region.

9. The collapsible bottle of claim 1, wherein the bottle comprises a hanging element configured for the bottle to be suspended in an upside-down orientation.

10. The collapsible bottle of claim 9, wherein the hanging element comprises a tab having a hanging aperture.

11. The collapsible bottle of claim 10, wherein the tab is positioned in an access channel that spans between the front and rear wall.

12. The collapsible bottle of claim 11, wherein the access channel extends upward from the base, dividing the base of the bottle into independent right and left portions, wherein the upper edge of the tab, the right edge of the tab, and the left edge of the tab are each integrally connected with a surface that defines the access opening.

13. The collapsible bottle of claim 12, wherein a lower edge of the tab is positioned upward of a standing surface of the base.

14. The collapsible bottle of claim 12, wherein the access channel has a first width at the front and rear walls and a second width at the tab, the first width being greater than the second width.

15. The collapsible bottle of claim 14, wherein the first width is at between 120% and 150% greater than the second width.

16. The collapsible bottle of claim 1, wherein the bottle has a tilt angle of at least 12 degrees.

17. The collapsible bottle of claim 1, wherein the base of the bottle does not deform during the collapse.

18. A collapsible bottle comprising:

a base;

a neck that defines an opening;

a front wall;

a rear wall;

left and right side walls, each of the left and right side walls comprising a rounded shoulder region that transitions to the neck, a lower transition region that transitions into the base, and a central region positioned between the rounded shoulder region and the lower transition region, the central region comprising a first panel and a second panel, the first and second panels being divided by a substantially vertical central hinge, the first panel being divided from the front wall by a front hinge, and the second panel being divided from the rear wall by a rear hinge;

wherein, when pressure is placed on the front and rear walls of the bottle, the front hinge line flexes inward, the rear hinge line flexes inward, and the central hinge flexes outward, such that the front and rear walls collapse toward one another with the central hinge being pushed outward away from the front and rear walls;

wherein the first panel is angled inward from the central hinge toward the front hinge and the second panel is angled inward from the central hinge toward the rear hinge; and wherein each of the front hinge and the rear hinge comprises an outward-projecting rib.

19. The collapsible bottle of claim 18, wherein the rib of the front hinge comprises an apex, a convex portion that transitions from the apex into the front wall, and a concave portion that transitions from the apex into the first panel; and the rib of the rear hinge comprises an apex, a convex portion that transitions from the apex into the rear wall, and a concave portion that transitions from the apex into the second panel.

20. The collapsible bottle of claim 19, wherein each of the front and rear hinges has (a) an outer curvature between about 135 degrees and about 165 degrees;

(b) an inner curvature between about 140 degrees and about 180 degrees; or (c) both a and b.

21. The collapsible bottle of claim 19, wherein the central, front, and rear hinges each fades toward the top of the central region such that each of the left and right side walls has a continuously curved cross-section adjacent the rounded shoulder region.

22. The collapsible bottle of claim 18, wherein the center hinge fades toward the top of the central region such that each of the left and right side walls has a curved cross-section adjacent the rounded shoulder region.

23. The collapsible bottle of claim 18, wherein each of the front and rear walls has an upper arched region.

24. The collapsible bottle of claim 18, wherein the bottle comprises a hanging element configured for the bottle to be suspended in an upside-down orientation.

25. The collapsible bottle of claim 24, wherein the hanging element comprises a tab having a hanging aperture.

26. The collapsible bottle of claim 25, wherein the tab is positioned in an access channel that spans between the front and rear wall.

27. The collapsible bottle of claim 26, wherein the access channel extends upward from the base, dividing the base of the bottle into independent right and left portions, wherein the upper edge of the tab, the right edge of the tab, and the left edge of the tab are each integrally connected with a surface that defines the access opening.

28. The collapsible bottle of claim 27, wherein a lower edge of the tab is positioned upward of a standing surface of the base.

29. The collapsible bottle of claim 27, wherein the access channel has a first width at the front and rear walls and a second width at the tab, the first width being greater than the second width.

30. The collapsible bottle of claim 29, wherein the first width is between 120% and 150% greater than the second width.

31. The collapsible bottle of claim 18, wherein the bottle has a tilt angle of at least 12 degrees.

32. The collapsible bottle of claim 18, wherein the base of the bottle does not deform during the collapse.

33. A collapsible bottle comprising:

a base;

a neck that defines an opening;

a front wall;

a rear wall;

left and right side walls, each of the left and right side walls comprising a rounded shoulder region that transitions to the neck, a lower transition region that transitions into the base, and a central region positioned between the rounded shoulder region and the lower transition region, the central region comprising a first panel and a second panel, the first and second panels being divided by a substantially vertical central hinge, the first panel being divided from the front wall by a front hinge, and the second panel being divided from the rear wall by a rear hinge;

wherein, when pressure is placed on the front and rear walls of the bottle, the front hinge line flexes inward, the rear hinge line flexes inward, and the central hinge flexes outward, such that the front and rear walls collapse toward one another with the central hinge being pushed outward away from the front and rear walls;

wherein the bottle comprises a hanging element configured for the bottle to be suspended in an upside-down orientation;

wherein the hanging element comprises a tab having a hanging aperture; and wherein the tab is positioned in an access channel that spans between the front and rear wall.

34. The collapsible bottle of claim 33, wherein the access channel extends upward from the base, dividing the base of the bottle into independent right and left portions, wherein the upper edge of the tab, the right edge of the tab, and the left edge of the tab are each integrally connected with a surface that defines the access opening.

35. The collapsible bottle of claim 34, wherein a lower edge of the tab is positioned upward of a standing surface of the base.

36. The collapsible bottle of claim 34, wherein the access channel has a first width at the front and rear walls and a second width at the tab, the first width being greater than the second width.

37. The collapsible bottle of claim 36, wherein the first width is between 120% and 150% greater than the second width.

38. The collapsible bottle of claim 33, wherein the base of the bottle does not deform during the collapse.

* * * * *